US005703311A

United States Patent [19]

Ohta

[11] Patent Number: 5,703,311

[45] Date of Patent: Dec. 30, 1997

[54] ELECTRONIC MUSICAL APPARATUS FOR SYNTHESIZING VOCAL SOUNDS USING FORMAT SOUND SYNTHESIS TECHNIQUES

[75] Inventor: Shinichi Ohta, Hamamatsu, Japan

[73] Assignee: Yamaha Corporation, Japan

[21] Appl. No.: 687,976

[22] Filed: Jul. 29, 1996

[30] Foreign Application Priority Data

Aug. 3, 1995 [JP] Japan ..... 7-216494
Aug. 21, 1995 [JP] Japan ..... 7-234731

[51] Int. Cl.[6] ..... G10H 1/06; G10H 7/00

[52] U.S. Cl. ..... 84/622; 395/218

[58] Field of Search ..... 84/600, 622, 659; 395/2.16–2.19, 2.87

[56] References Cited

U.S. PATENT DOCUMENTS

| | | | |
|---|---|---|---|
| 4,527,274 | 7/1985 | Gaynor | 395/2 |
| 4,618,985 | 10/1986 | Pfeiffer . | |
| 4,731,847 | 3/1988 | Lybrook et al. | 395/2 |
| 4,788,649 | 11/1988 | Shea et al. . | |
| 5,235,124 | 8/1993 | Okamura et al. | 84/601 |
| 5,321,794 | 6/1994 | Tamura . | |
| 5,400,434 | 3/1995 | Pearson . | |

FOREIGN PATENT DOCUMENTS

| | | |
|---|---|---|
| 58-37693 | 3/1983 | Japan . |
| 3-200299 | 9/1991 | Japan . |
| 4-349497 | 12/1992 | Japan . |

*Primary Examiner*—William M. Shoop, Jr.
*Assistant Examiner*—Jeffrey W. Donels
*Attorney, Agent, or Firm*—Graham & James LLP

[57] ABSTRACT

An electronic musical apparatus is designed to sing a song based on performance data which indicate a melody originally played by a musical instrument. Herein, the apparatus contains a formant tone generator and a data memory which stores a plurality of formant data, lyric data and melody data. Formant synthesis method is employed for voice synthesis to generate voices based on the plurality of formant data selectively designated by the lyric data so that the voices are sequentially generated in accordance with words of a song. Thus, the song is automatically swung by sequentially generating the voices in accordance with a melody which is designated by. the melody data; and the voice synthesis is controlled such that generation of the voices temporarily stopped at timings of pausing for breath. Moreover, the data memory can store formant parameters with respect to each phoneme, so that the formant tone generator can gradually shift sounding thereof from a first phoneme (e.g., a consonant) to a second phoneme (e.g., a vowel). Herein, formant parameters, regarding the first phoneme, are supplied to the formant tone generator in a pre-interpolation time between a first phoneme sounding-start-time and an interpolation start time. Then, Interpolation is effected on the formant parameters to achieve gradual shifting of the sounding. A pace for the shifting of the sounding from the first phoneme to the second phoneme can be changed on demand.

17 Claims, 16 Drawing Sheets

ELECTRONIC MUSICAL APPARATUS FOR SYNTHESIZING VOCAL SOUNDS USING FORMAT SOUND SYNTHESIS TECHNIQUES

BACKGROUND OF THE INVENTION

1. Field of the Invention

The invention relates to electronic musical apparatuses which use formant sound synthesis to synthesize sounds or voices for the music. Herein, the electronic musical apparatuses refer to electronic musical instruments, sequencers, automatic performance apparatuses, sound source modules and karaoke systems as well as personal computers, general-use computer systems, game devices and any other information processing apparatuses which are capable of processing music information in accordance with programs, algorithms and the like.

2. Prior Art

Among the electronic musical apparatuses, there are provided singing voice synthesizing apparatuses which produce human voices to sing a song. In addition, there are provided a variety of voice synthesis methods, one of which is a formant synthesis method. For example, the paper of Japanese Patent Laid-Open No. 3-200299 discloses a voice synthesis apparatus which performs voice synthesis in accordance with the formant synthesis method.

Further, the paper of Japanese Patent Laid-Open No. 58-37693 discloses a singing-type electronic musical instrument. Herein, voices indicating words of a lyric of a song are inputted to produce voice data which are recorded in a recording medium before execution of musical performance. At a performance mode, the voice data are read out from the recording medium by manipulation of a keyboard while tone pitches are designated as well. So, the electronic musical instrument produces the voices in an order to input the words so as to sing a song.

The above electronic musical instrument is designed to sing a song based on the voice data which are made for the singing in accordance with a voice synthesis technique. Until now, however, no one proposes an electronic musical instrument having a function to sing a song based on performance data which are created for normal performance of musical instruments. Such a function may be achieved by modifying an automatic performance apparatus such that Its sound source (or tone generator) is simply replaced by a voice synthesis device by which voices are produced in accordance with a lyric. However, such a modified automatic performance apparatus produces the voices based on performance data which are originally created for performance of a musical instrument. So, there is a problem that if a song is sung using the voices produced based on the performance data, the song will sound un-natural.

Therefore, there is a need to provide a singing voice synthesizing apparatus which is capable of singing a song in a natural manner based on performance data originally created for performance of a musical instrument.

Meanwhile, according to the known conventional technology, CSM analysis method (where 'CSM' is an abbreviation for 'Composite Sinusoidal Model') is used to analyze actual voice data to obtain formant data, which are sent to a voice synthesis apparatus, providing a formant generation device, so as to generate voices. Herein, the formant data represent time-series parameters indicating formant center frequency, formant level and formant bandwidth.

For example, the paper of Japanese Patent Laid-Open No. 3-200299 discloses a voice synthesis apparatus providing multiple formant generation sections. Another paper of Japanese Patent Laid-Open No. 4-349497 discloses an electronic musical instrument using multiple sets of time-series parameters which designate formants. Generally, the formants are varied fine with respect to time, so parameters, each representing voice data at each moment, are arranged in a time-series manner. The multiple sets of time-series parameters are stored in a storage circuit with respect to tone generators respectively. At every key-on event, they are read out and are transferred to a formant-synthesis-type tone generator. Thus, the electronic musical instrument plays a performance using voices.

The above technologies are designed such that a tone generator, employing the formant synthesis method, is used to generate voices, speak words or sing a song. However, in order to analyze the voice data in accordance with the CSM analysis method to calculate a series of formant data, remarkably high performance of calculations is required; and the cost required for manufacturing the apparatus should be increased as well. Further, in order to gradually change voices to normal musical tones, tone color should be edited. However, the conventional apparatus can hardly edit the tone color in such a way.

Meanwhile, when generating vocal sounds (or vocalized sounds) of 'A', 'I', 'U', 'E' and 'O', which are vowels in the Japanese syllabary, a tone-color file (i.e., formant parameters of a phoneme) is provided for each vocal sound. So, when shifting a phoneme to another phoneme, formant parameters are gradually changed (or interpolated), so that a sound is generated. Such a method is called a 'morphing' technique.

For example, when generating the vocal sounds of 'A', 'I', 'U', 'E' and 'O' with being smoothly shifted, the morphing technique should be performed. In that case, morphing interpolation of formant parameters is started at a moment to start generation of each phoneme. If so, the phoneme of 'A' is immediately changed by the morphing interpolation; therefore, it becomes hard for a person to clearly hear the vocal sound of 'A'. That is, there is a problem that due to the morphing interpolation, the vocal sounds are hardly recognized on the sense of hearing.

Therefore, there is a need to provide a formant parameter creating device which creates formant parameters for a formant tone generator in such a way that voices are synthesized without requiring high performance of calculations while tone-color editing is performed to smoothly change voices to musical tones. In addition, there is a need to provide a formant parameter creating device which creates formant parameters for a voice synthesis apparatus, employing the formant synthesis method, in such a way that the synthesized voices can be clearly heard on the sense of hearing even if the morphing technique is performed.

SUMMARY OF THE INVENTION

It is an object of the invention to provide an electronic musical apparatus which uses formant sound synthesis to generate voices for singing a song, wherein the voices are synthesized as clear sounds which can be clearly recognized on the sense of hearing.

An electronic musical apparatus of the invention is designed to sing a song based on performance data which indicate a melody originally played by a musical instrument. Herein, the apparatus contains a formant tone generator and a data memory which stores a plurality of formant data, lyric data and melody data, wherein the formant data correspond to each syllable of a language (e.g., each of 50 vocal sounds of the Japanese syllabary) by which the song is sung whilst lyric data designate words of a lyric of the song as well as timings of pausing for breath. Formant synthesis method is employed for voice synthesis to generate voices based on the plurality of formant data selectively designated by the lyric data so that the voices are sequentially generated in accordance with the words of the song. Thus, the song is automatically sung by sequentially generating the voices in accordance with a melody which is designated by the melody data; and the voice synthesis is controlled such that generation of the voices is temporarily stopped at the timings of pausing for breath.

Moreover, the data memory can store formant parameters with respect to each phoneme, so that the formant tone generator can gradually shift sounding thereof from a first phoneme (e.g., a consonant) and a second phoneme (e.g., a vowel). Herein, formant parameters, regarding the first phoneme, are supplied to the formant tone generator in a pre-interpolation time between a first phoneme sounding-start-time and an interpolation start time. The pre-interpolation time can be calculated by multiplying a sounding time of the first phoneme and an interpolation dead rate together. Then, interpolation is effected on the formant parameters, so that results of the interpolation are sequentially supplied to the formant tone generator. Thus, the formant tone generator synthesizes formant-related sound based on the first and second phonemes. Incidentally, a pace for the shifting of the sounding from the first phoneme to the second phoneme can be changed on demand.

BRIEF DESCRIPTION OF THE DRAWINGS

These and other objects of the subject invention will become more fully apparent as the following description is read in light of the attached drawings wherein.

DESCRIPTION OF THE PREFERRED EMBODIMENTS

Now, preferred embodiments of the invention will be described with reference to the drawings.

[A] Singing-type electronic musical instrument

Figure 1:
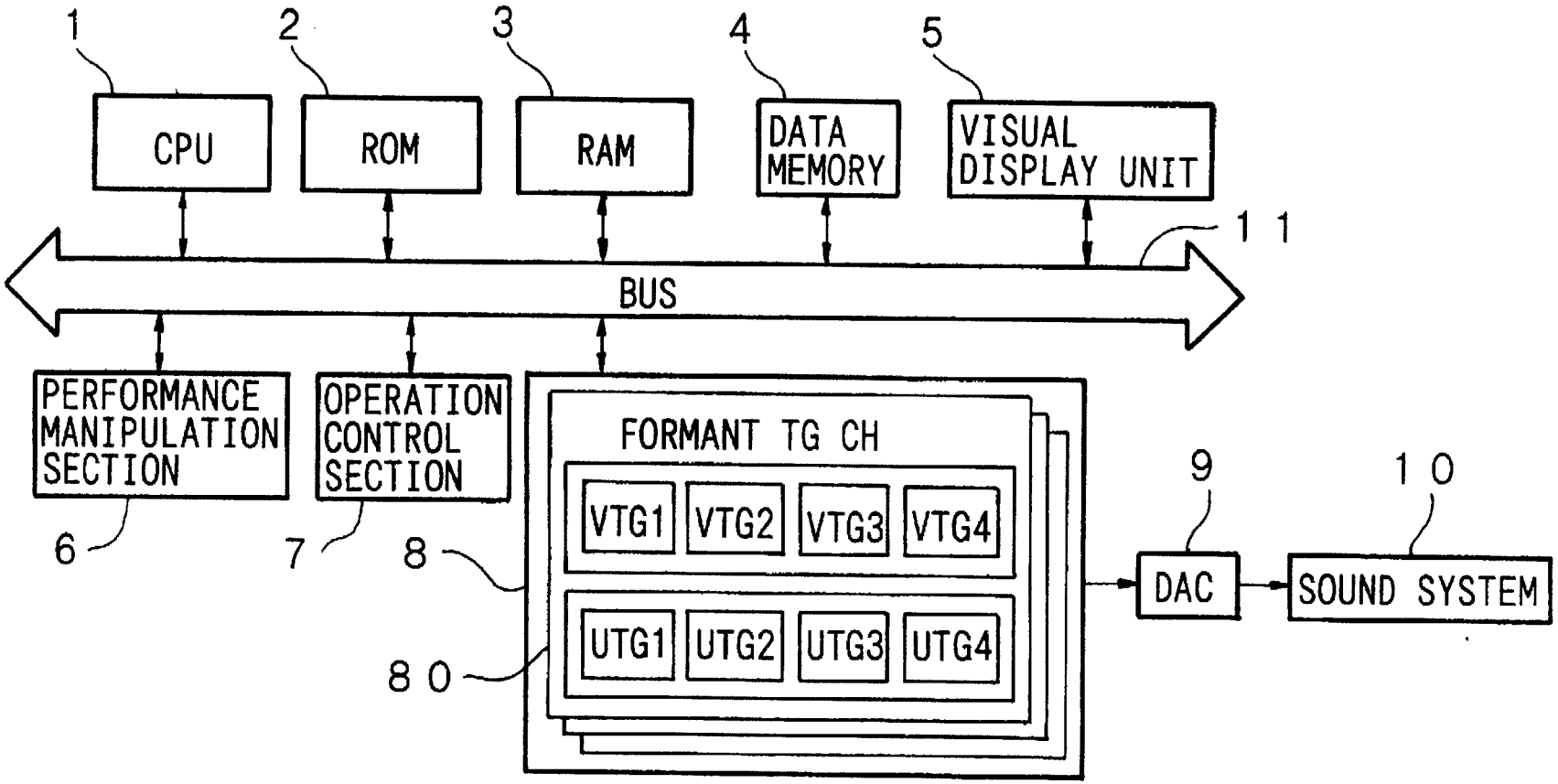
FIG. 1 is a block diagram showing a configuration of a singing-type electronic musical instrument which is designed in accordance with a first embodiment of the invention.

FIG. 1 is a block diagram showing a singing-type electronic musical instrument (or singing-type electronic musical apparatus) which is designed in accordance with a first embodiment of the invention. This apparatus is constructed by a central processing unit (i.e., CPU) 1, a read-only memory (i.e., ROM) 2, a random-access memory (i.e., RAM) 3, a data memory 4, a visual display unit 5, a performance manipulation section 6 containing performance-manipulation members such as switches and keys of a keyboard which are manipulated by a human operator (e.g., performer) to play a music, an operation control section 7 containing operation-control members such as a switch to designate a performance mode, a formant tone generator 8, a digital-to-analog converter (abbreviated by 'D/A converter') 9 and a sound system 10. Herein, a bus 11 is provided to interconnect circuit elements 1 to 8 together. The CPU 1 is provided to perform overall control of the apparatus; and the ROM 2 store programs, which are executed by the CPU 1, as well as tables which are required for execution of the programs. The RAM 3 is used as a working area for the CPU 1 which stores data corresponding to results of calculations. The data memory 4 stores formant data, used for voice synthesis, as well as lyric data and melody data (i.e., performance data). The visual display unit 5 visually displays a variety of parameters and operation modes of the apparatus on a screen. The formant tone generator 8 synthesizes voices (or vocalized sounds) or musical tones based on the formant data. The D/A converter 9 converts digital signals, which are outputted from the formant tone generator 8, to analog signals. The sound system 10 amplifies the analog signals to produce sounds from a speaker (or speakers).

The formant tone generator 8 has a plurality of tone-generator channels designated by a numeral '80'. Specifically, the tone-generator channel 80 is constructed by four vowel formant generating sections VTG1 to VTG4 and four consonant formant generating sections UTG1 to UTG4. That is, four formant generating sections are provided for each of the vowel and consonant, so that outputs of these formant generating sections are added together to synthesize a voice. Such a method is well known by the aforementioned paper of Japanese Patent Laid-Open No. 3-20299, for example.

Figure 2:
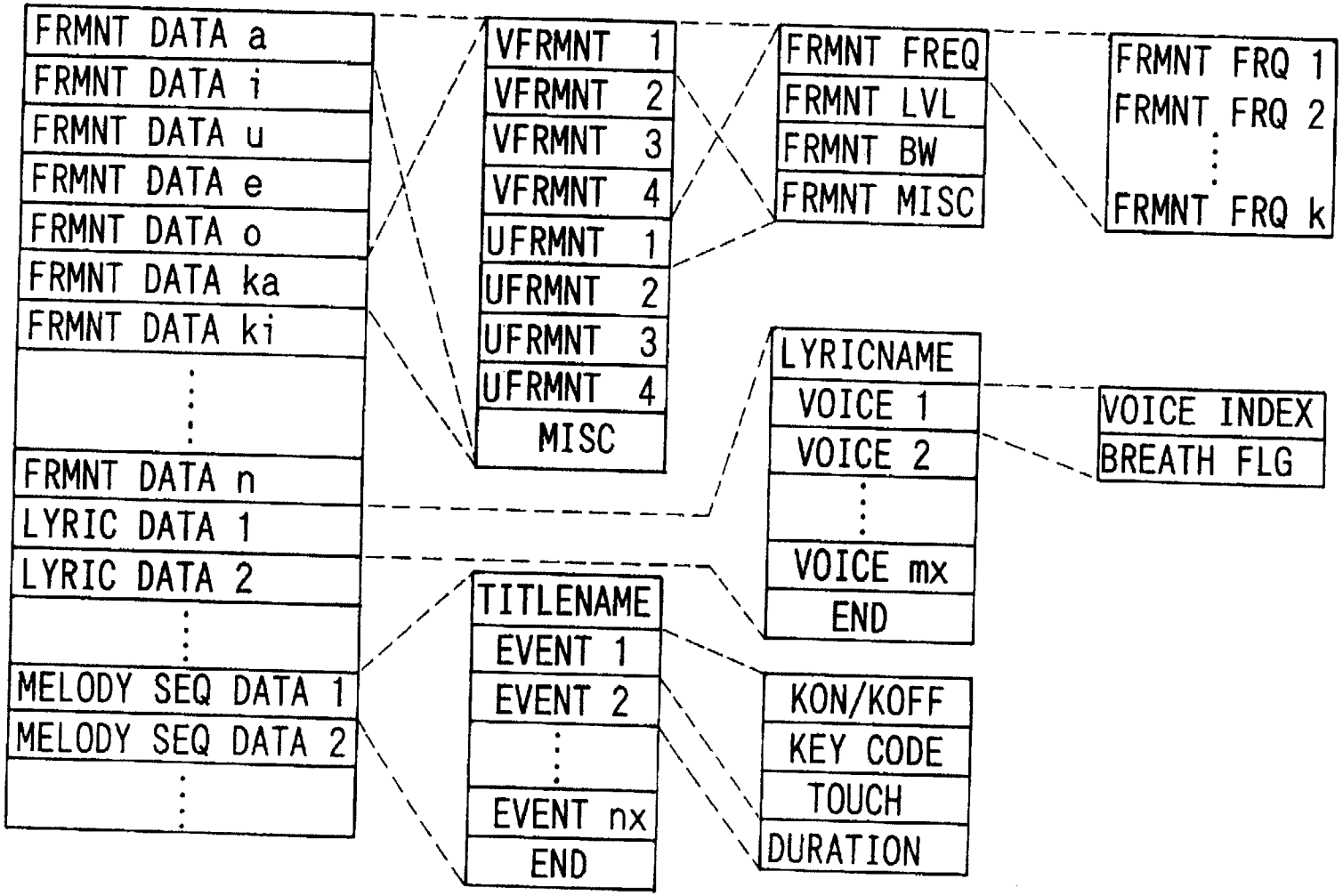
FIG. 2 shows an example of a configuration of data stored in a data memory shown in FIG. 1.

FIG. 2 shows a configuration of data stored in the data memory 4. Namely, the data memory 4 stores formant data 'FRMNTDATA', lyric data 'LYRICDATA' and melody data 'MELODYSEQDATA'.

The formant data FRMNTDATA contain a plurality of data FRMNTDATAa, FORMNTDATAi, . . . which respectively correspond to 50 vocal sounds of the Japanese syllabary (or 50 different syllables of the Japanese language). Each formant data FRMNTDATA consist of parameters VFRMNT1 to VFRMNT4, parameters UFRMNT1 to UFRMNT4 and data MISC. Herein, the parameters VFRMNT1 to VFRMNT4 are respectively supplied to the vowel formant generating sections VTG1 to VTG4 whilst the parameters UFRMNT1 to UFRMNT4 are respectively supplied to the consonant formant generating sections UTG1 to UTG4. The data MISC corresponds to level correction data which are used to harmonize tone volumes on the sense of hearing, for example. Each of the parameters consists of formant center frequency FRMNTFREQ, formant level FRMNTLVL, formant bandwidth FRMNTBW and other data FRMNTMISC which indicate a rise-up timing of each formant component, for example. Further, the formant center frequency FRMNTFREQ consists of 'k' time-series data (where 'k' is an integer arbitrarily selected), i.e., FRMNTFRQ1, FRMNTFRQ2, . . . and FRMNTFRQk. Similarly, each of the formant level FRMNTLVL and the formant bandwidth FRMNTBW consists of k time-series data which are not shown in FIG. 2. Those time-series data are read out by each frame timing so that a time-varying formant is reproduced.

Incidentally, if it is necessary to compress storage capacity required for storing the aforementioned time-series data of the formant center frequency or the like, a manner to store the time-series data can be modified as follows:

Data are stored in a rough manner with respect to a lapse of time; then, data, which are precise in a lapse of time, are produced by performing interpolation calculations on the data roughly stored. Or, as for a constant portion of data, constant data (or data in a certain interval) are repeatedly read out in a loop manner.

The lyric data LYRICDATA consist of a lyric name LYRICNAME, a plurality of voice sequence data $VOICE_1$, $VOICE_2$, . . . , $VOICE_{mx}$ and end data END. Herein, each of 'mx' voice sequence data correspond to each of phonemes in the lyric. Further, each voice sequence data VOICE consist of index data VOICEINDEX, representing designation of the formant data FRMNTDATA, and breath flag BREATHFLG representing a timing of pausing for breath. As for vocal sounds of "Sa-I-Ta" in the Japanese language, for example, the vocal sound of "Sa" is stored as $VOICE_1$1; the vocal sound of "I" is stored as $VOICE_2$; and the vocal sound of "Ta" is stored as $VOICE_3$. If BREATHFLG=1, its corresponding phoneme is muted at a key-off event. If a duration is designated as a period of time which elapses until a key-on event of a next phoneme, a non-sound period is established between the key-on event and the key-off event.

The melody data MELODYSEQDATA consist of a title name TITLENAME, 'nx' event data $EVENT_1$, $EVENT_2$, . . . , $EVENT_{nx}$, which correspond to performance events respectively, and end data END. Further, each event data EVENT are made by key-on/key-off data which consist of data KON or KOFF, representing a key-on event or a key-off event, as well as data KEYCODE, representing a keycode, and data TOUCH representing a touch; or each event data EVENT are made by duration data DURATION. Incidentally, the apparatus of the present embodiment is designed to sing a song in a monophonic manner. Therefore, the apparatus is designed to deal with 'monophonic' performance data. In which multiple key-on events do not occur simultaneously.

Figure 3:
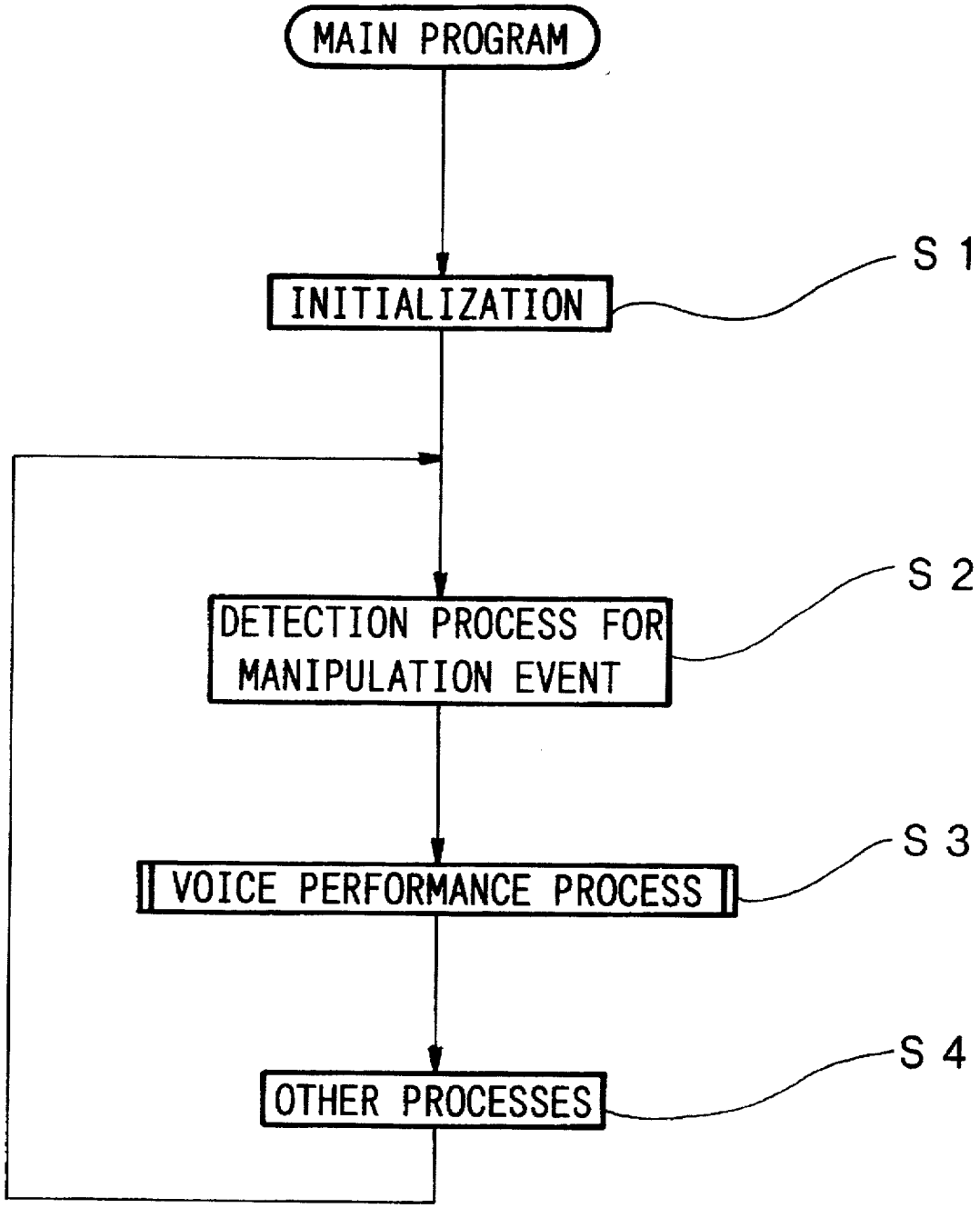
FIG. 3 is a flowchart showing a main program executed by a CPU shown in FIG. 1.

FIG. 3 is a flowchart showing steps of a main program which is executed by the CPU 1. This main program is initiated when electric power is applied to the apparatus. In first step S1, initialization is performed to set the parameters to their prescribed conditions or prescribed values. In next step S2, a detection process is performed to detect manipulation events which occur on the performance-manipulation members and/or the operation-control members. In step S3, the CPU 1 executes a voice performance process, details of which are shown by flowcharts of FIGS. 4, SA and 5B. In step S4, the CPU 1 performs other processes. After completion of the step S4, the CPU 1 proceeds back to the step S2. The apparatus repeats execution of the steps S2 to S4 as long as the electric power is applied thereto.

Next, the details of the voice performance process will be described with reference to FIGS. 4A, 4B, 5A and 5B.

Figure 4A:
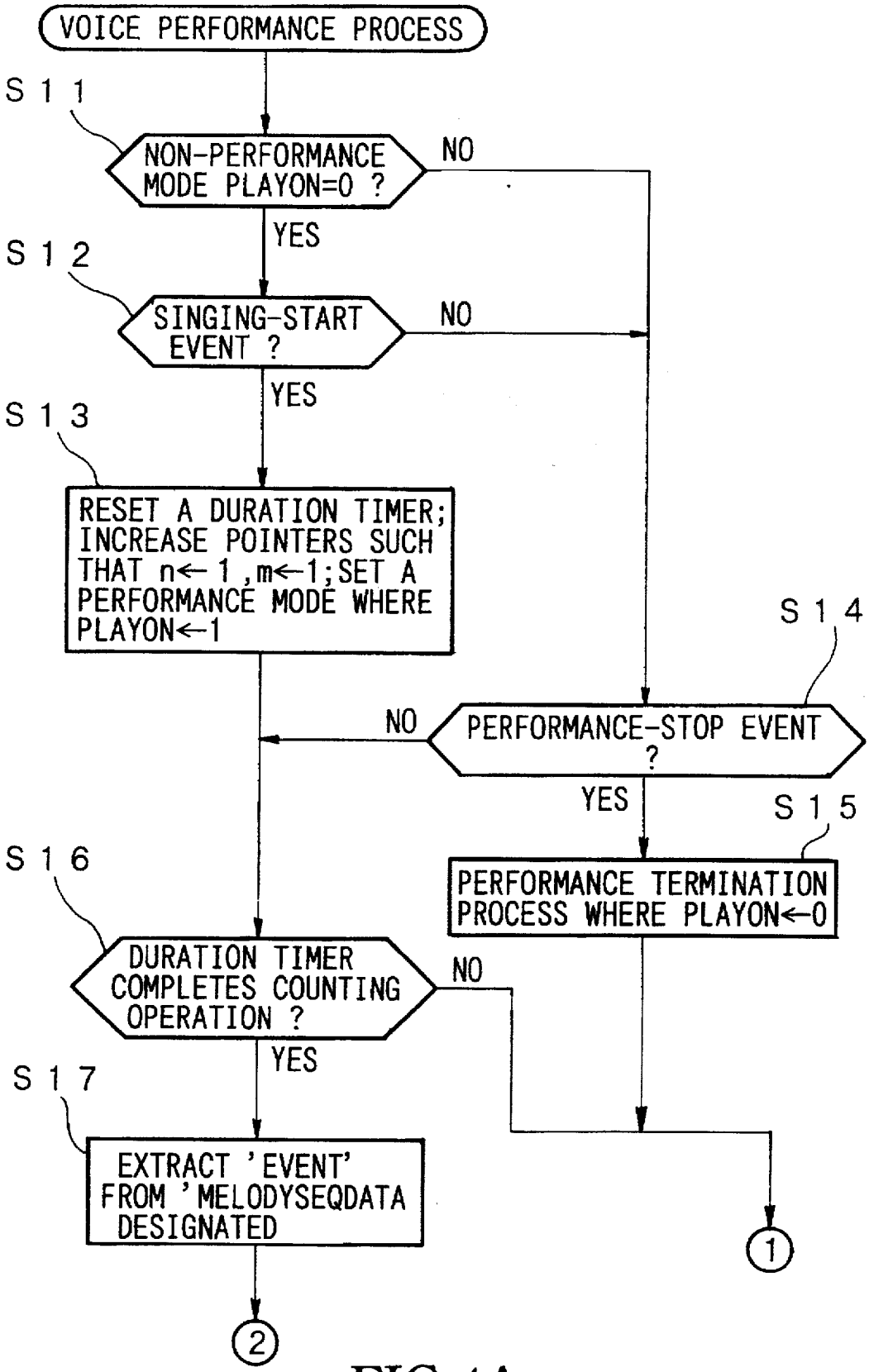
FIGS. 4A, 4B, 5A and 5B are flowcharts showing a voice performance process executed by the CPU.
Figure 4B:
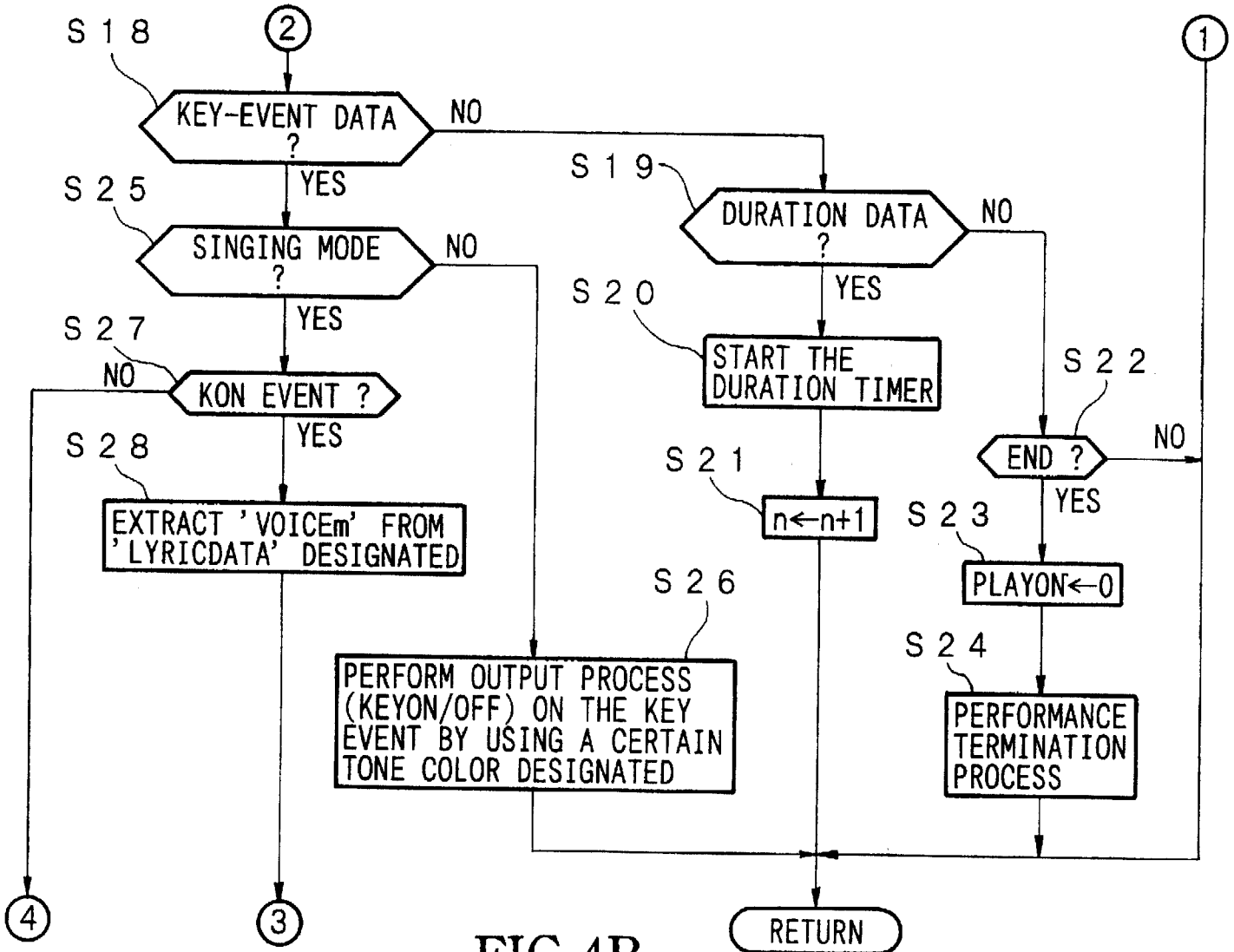
Figure 5B:
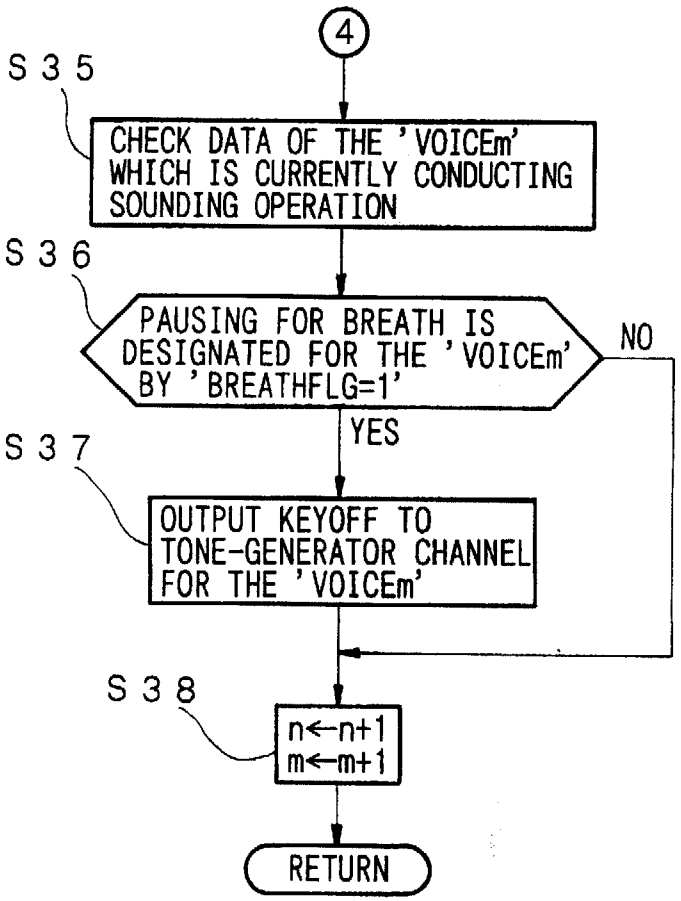
Figure 5A:
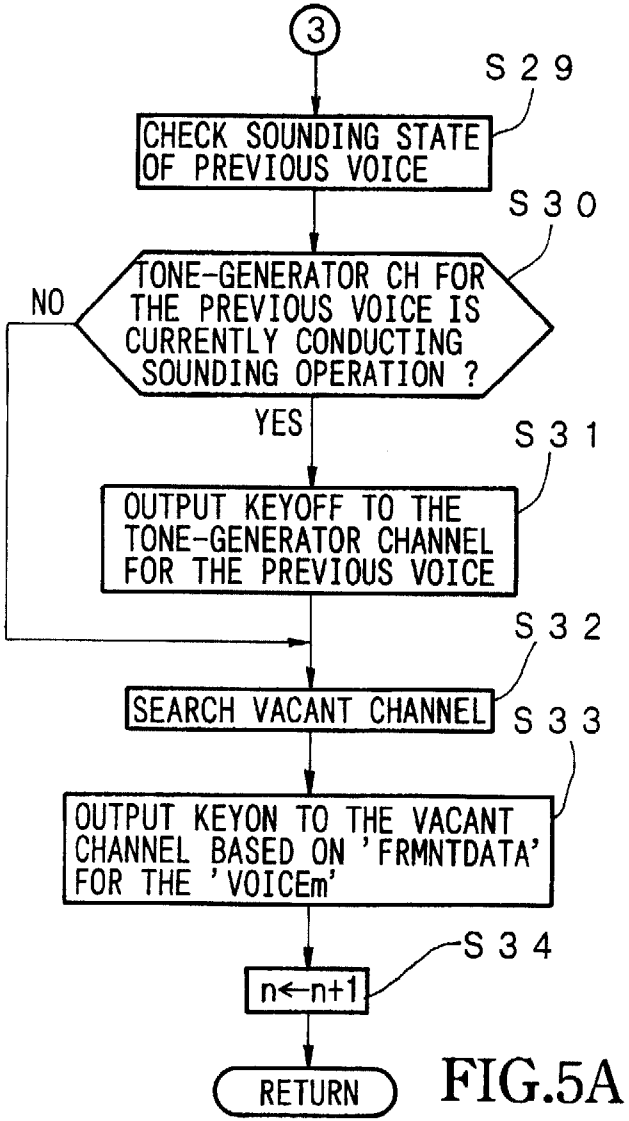

In first step S11 of FIG. 4A, a decision is made as to whether a performance flag PLAYON is set at '0' or '1', wherein if PLAYON=1, it is indicated that performance is now progressing. In other words, a decision is made as to whether the apparatus is set in a performance mode or a non-performance mode. In the non-performance mode (i.e., PLAYON=0), the apparatus proceeds to step S12 in which a decision is made as to whether or not a singing-start event occurs. If it is detected that the singing-start event occurs in the non-performance mode, the apparatus proceeds to step S13 in which a duration timer, used for measuring a duration, is reset; '1' is set to both of an event pointer 'n' and a lyric pointer 'm'; thereafter, the performance flag PLAYON is set at '1'. Thereafter, the apparatus proceeds to step S16.

If result of the decision made by the step S11 or S12 is 'NO', in other words, if the singing-start event does not occur in the performance mode or non-performance mode, the apparatus proceeds to step S14 in which a decision is made as to whether or not a performance-stop event occurs. If it is detected that the performance-stop event does not occur, the apparatus proceeds to step S16. On the other hand, if it is detected that the performance-stop event occurs, the apparatus proceeds to step S15 which performs a performance termination process. Specifically, the performance flag PLAYON is reset to '0' while a muting process is performed to stop sounding of channels which currently contributes to generation of sounds. Thereafter, the voice performance process is terminated so that program control returns back to the main program.

In step S16, a decision is made as to whether or not the duration timer completes counting operation thereof. If the counting operation is not completed, execution of the voice performance process is terminated immediately. On the other hand, if the counting operation is completed, result of the decision made by the step S16 turns to 'YES', so that the apparatus proceeds to step S17. Herein, just after occurrence of a singing-start event, the duration timer is reset; therefore, the result of the decision of the step S16 should turn to 'YES'. In step S17, event data EVENTn are extracted from the melody data MELODYSEQDATA which are designated. In next step S18, a decision is made as to whether or not the event data $EVENT_n$ indicate a key event. If the event data $EVENT_n$ do not indicate the key event, the apparatus proceeds to step S19 in which a decision is made as to whether or not the event data $EVENT_n$ indicate duration data. If the event data $EVENT_n$ indicate the duration data, the apparatus proceeds to step S20 in which the duration timer is started. In step S21, the event pointer n is increased by '1'. Thereafter, execution of the voice performance process is ended. Meanwhile, if the step S19 detects that the event data $EVENT_n$ do not indicate the duration data, the apparatus proceeds to step S22 in which a decision is made as to whether or not the event data $EVENT_n$ indicate end data END. If the event data $EVENT_n$ do not indicate the end data END, execution of the voice performance process is ended. On the other hand, If the event data indicate the end data, the performance flag PLAYON is reset to '0' in step S23. In next step S24, like the aforementioned step S15, the apparatus executes performance termination process. Thus, execution of the voice performance process is ended.

If the step S18 detects that the event data $EVENT_n$ indicate key-event data, the apparatus proceeds to step S25 in which a decision is made as to whether or not the apparatus is set in a singing mode. In the singing mode, sounds designated by the performance data are generated as singing voices. If the apparatus is not set in the singing mode, in other words, if the apparatus is set in an automatic performance mode which is normally selected, the apparatus performs an output process for the key event currently designated (i.e., a key-on event or a key-off event) by using a certain tone color which is designated in advance in step S26. Then, execution of the voice performance process is ended.

In the singing mode, the apparatus proceeds to step S27 in which a decision is made as to whether or not the key event is a key-on event. In case of the key-on event, the apparatus proceeds to step S28 in which voice sequence data $VOICE_m$ are extracted from the lyric data LYRICDATA which are designated. Then, the apparatus proceeds to step S29 in FIG. 5A, wherein the apparatus checks a sounding state of 'previous' voice sequence data $VOICE_{m-1}$ which are placed before the voice sequence data $VOICE_m$. In step S30, a decision is made as to whether or not a tone-generator channel, corresponding to the previous voice sequence data $VOICE_{m-1}$, is currently conducting a sounding operation. If result of the decision indicates that the tone-generator channel does not conduct the sounding operation, the apparatus immediately proceeds to step S32. On the other hand, if result of the decision indicates that the tone-generator channel is currently conducting the sounding operation, the apparatus outputs a key-off instruction for the tone-generator channel; thereafter, the apparatus proceeds to step S32.

In step S32, the apparatus searches a vacant tone-generator channel which does not conduct a sounding operation. In next step S33, the apparatus outputs a key-on instruction for the vacant tone-generator channel, which is searched by the step S32, on the basis of the formant data FRMNTDATA corresponding to the voice sequence data $VOICE_m$. In step S34, the event pointer n is increased by '1'. Thereafter, execution of the voice performance process is ended.

Meanwhile, if result of the decision made by the aforementioned step S27 (see FIG. 4B) is 'NO', in other words, if the key event is a key-off event, the apparatus proceeds to step S35 (see FIG. 5B) in which the apparatus checks the voice sequence data $VOICE_m$ which currently correspond to a sounding operation. In step S36, a decision is made as to whether or not a breath flag BREATHFLG for the voice sequence data $VOICE_m$ is set at '1'; in other words, a decision is made as to whether or not pausing for breath is designated. In case of BREATHFLG=0, the apparatus immediately proceeds to step S38. In case of BREATHFLG=1, the apparatus outputs a key-off instruction for the tone-generator channel which is currently conducting the sounding operation; thereafter, the apparatus proceeds to step S38. In step S38, both of the event pointer n and the lyric pointer m are increased by '1'. Thereafter, execution of the voice performance process is ended.

According to the aforementioned voice performance process shown by FIGS. 4A, 4B, 5A and 5B, a muting process is not performed in the singing mode (see steps S36 and S37), except the case of BREATHFLG=1, even if a key-off event (or a note-off event) occurs; however, the muting process is performed at occurrence of a key-on event (or a note-on event) for next voice data (see steps S30 and S31). So, words of the lyric are continuously sounded, without being paused, as long as pausing for breath is not designated. Therefore, it is possible for the apparatus to sing a song in a natural manner on the basis of the performance data which are originally created for performance of a musical instrument.

Incidentally, the present embodiment can be modified to omit the breath flag BREATHFLG. In such a modification, the apparatus sings a song in such a way that all words of the lyric are continuously sounded without intermission.

In the present embodiment, the melody data MELODYSEQDATA are stored in the data memory 4. It is possible to modify the present embodiment such that the melody data are supplied to the apparatus from an external device by means of a MIDI interface.

Further, the voice synthesis method, applicable to the present embodiment, is not limited to the formant synthesis method. So, other methods can be employed by the present embodiment. Moreover, the CPU 1 can be designed to have a function to execute the voice-synthesis process.

Incidentally, the present embodiment is designed to generate voices corresponding to the Japanese language. However, the present embodiment can be modified to cope with other languages. In that case, the data memory 4 stores a plurality of formant data corresponding to syllables of a certain language such as the English language.

[B] Formant parameter creating method

Figure 10:
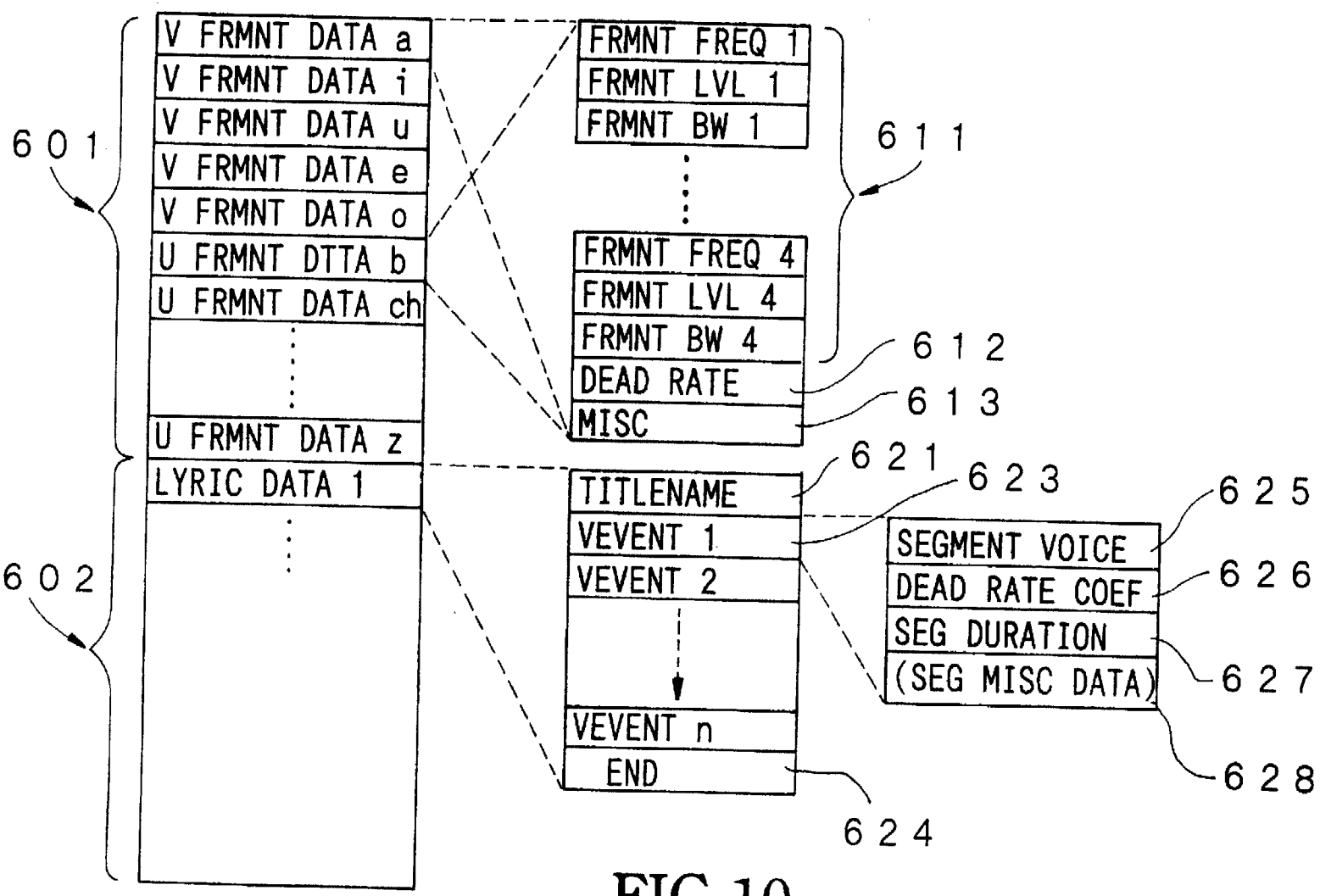
FIG. 10 shows content of a data memory which is used by the second embodiment.
Figure 11:
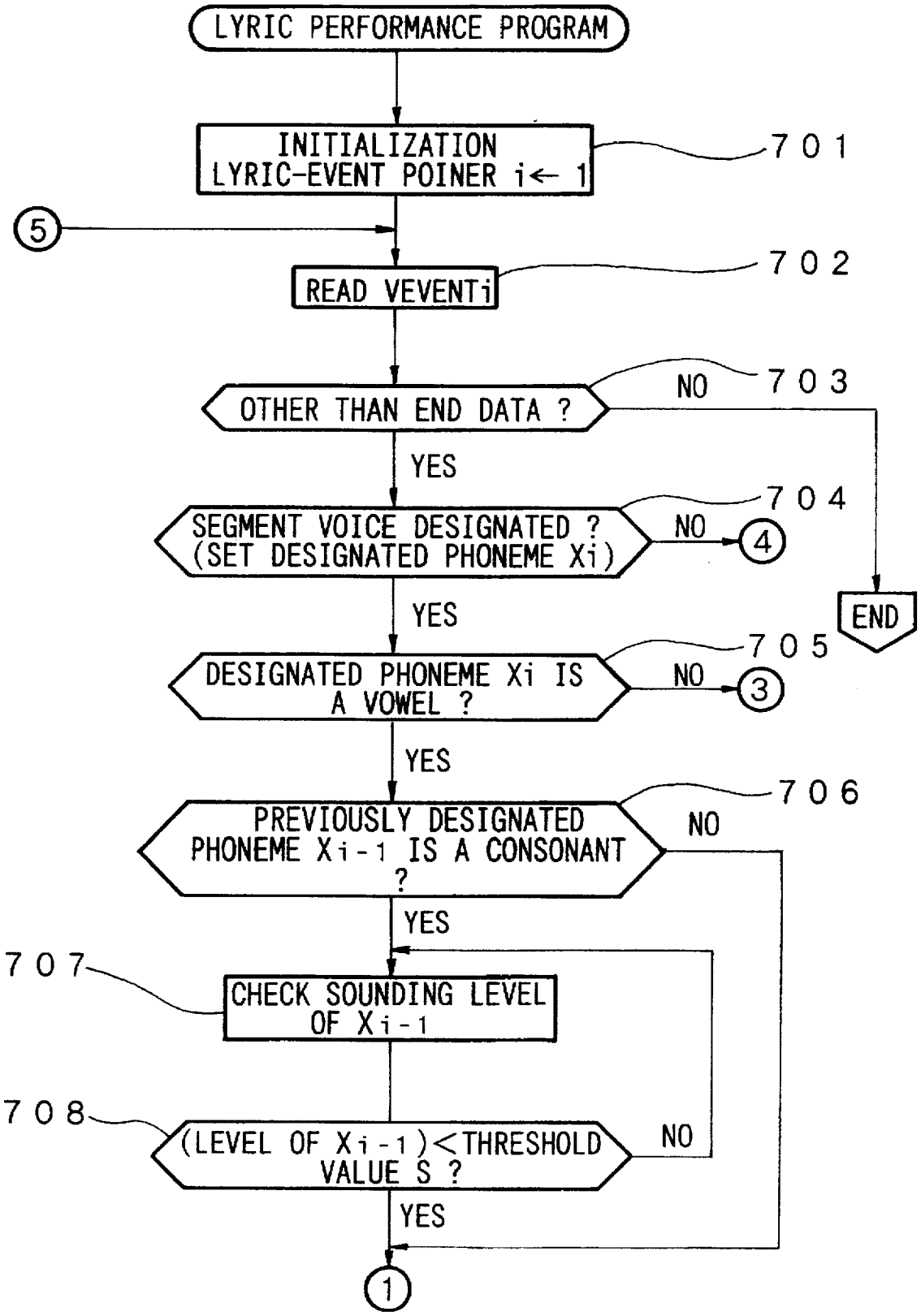
FIGS. 11, 12A, 12B, 12C, 13A and 13B are flowcharts showing procedures of a lyric performance program executed by the second embodiment.
Figure 12A:
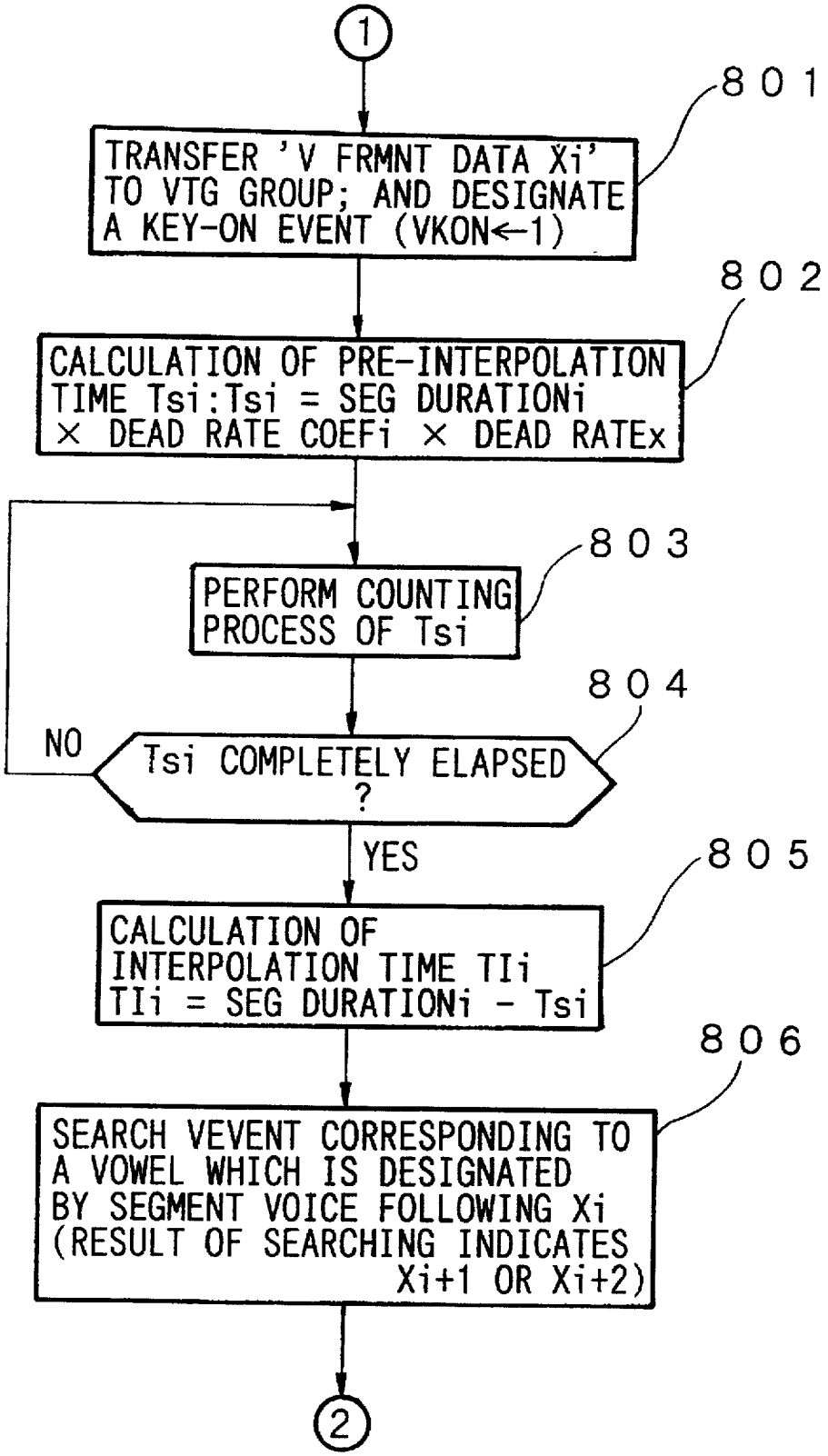
Figure 12B:
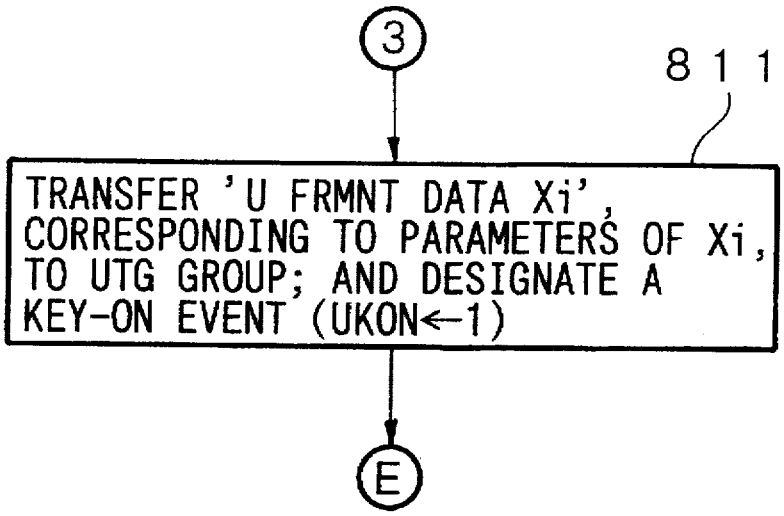
Figure 12C:
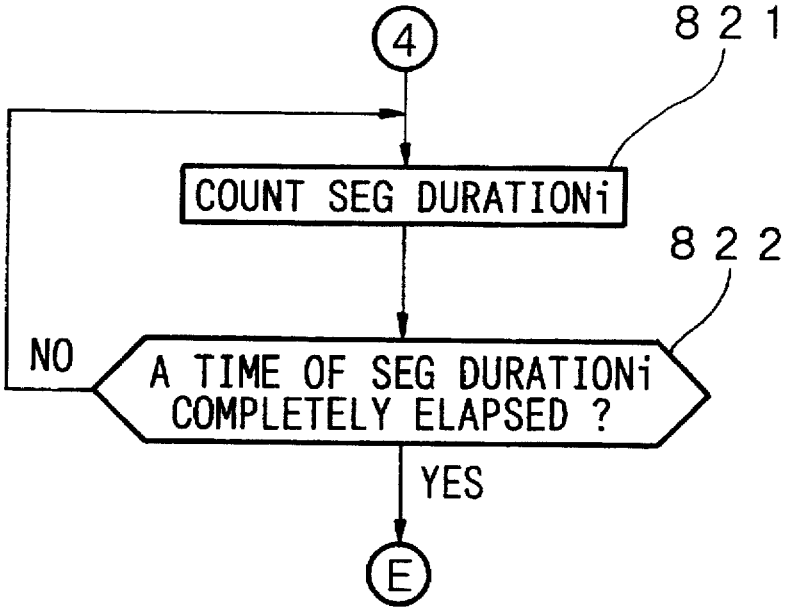

Next, the description will be given with respect to a formant parameter creating method which is realized by software processing in accordance with a second embodiment of the invention; and this method can be accomplished by the electronic musical apparatus of FIG. 1. Herein, the data memory 4 is replaced by a data memory 104 which stores a formant parameter table and a sequence table as shown in FIG. 10. The contents of those tables will be explained later with reference to FIG. 10. In the present embodiment, the formant tone generator 8 is replaced by a formant tone generator 108.

Figure 6:
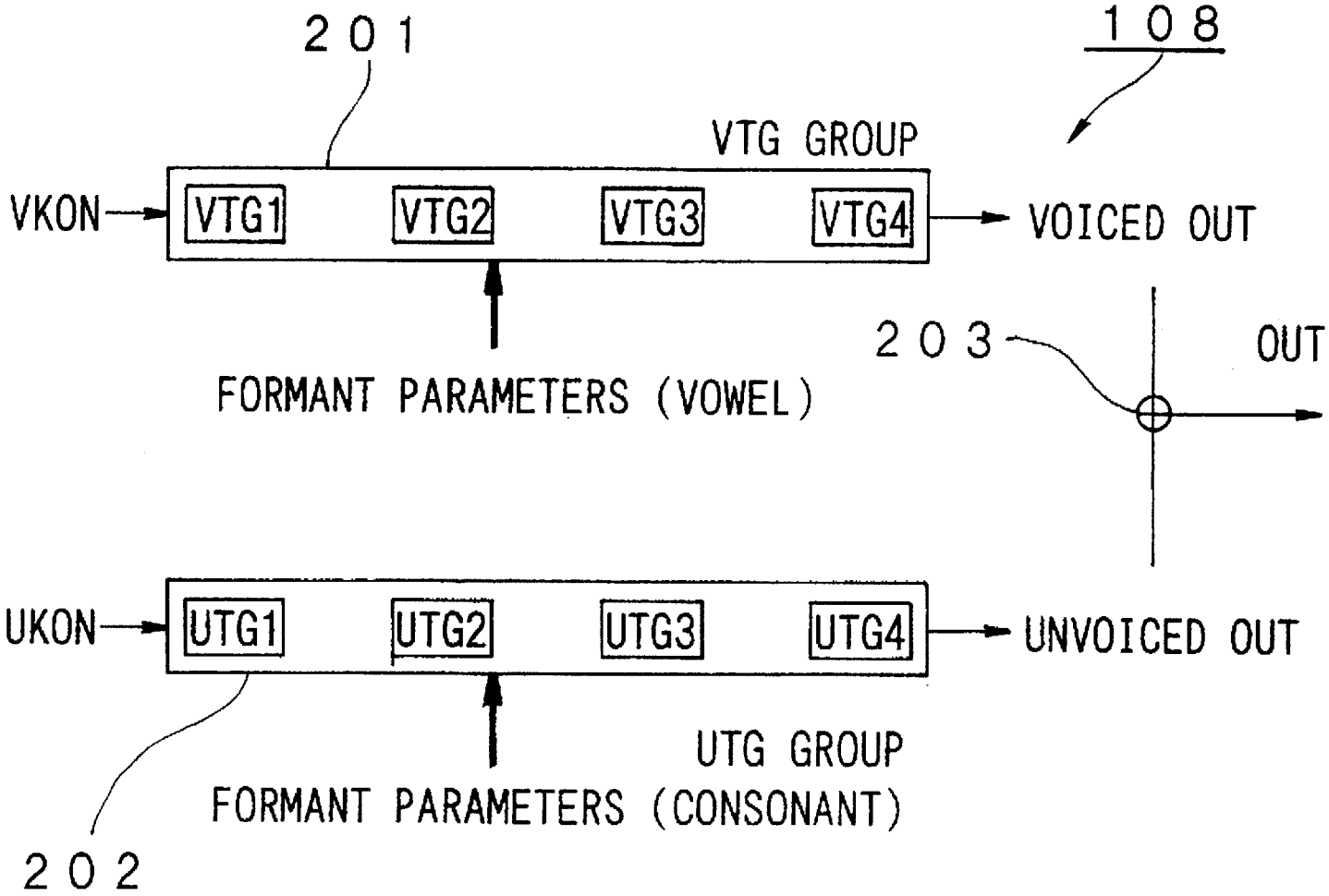
FIG. 6 shows a configuration of a formant tone generator which is used by a second embodiment of the invention.

FIG. 6 diagrammatically shows an example of an internal configuration of the formant tone generator 108. The formant tone generator 108 is roughly configured by two sections, i.e., a VTG group 201 and a UTG group 202.

The VTG group 201 is provided to generate vowels and is configured by 4 tone generators VTG1 to VTG4. Each tone generator forms one formant corresponding to formant parameters which are supplied thereto from the CPU 1 with respect to a voiced sound. The tone generator starts a voice generation sequence upon input of a key-on signal (VKON) from the CPU 1. Thus, digital musical tone signals, which are respectively outputted from the 4 tone generators VTG1 to VTG4, are mixed together to form a musical tone signal regarding a voiced sound providing 4 formants.

The UTG group 202 is provided to generate consonants and is configured by 4 tone generators UTG1 to UTG4. Each tone generator forms one formant corresponding to formant parameters which are supplied thereto from the CPU 1 with respect to a consonant. The tone generator starts a voice generation sequence upon input of a key-on signal (UKON) from the CPU 1. Digital musical tone signals, which are respectively outputted from the 4 tone generators UTG1 to UTG4, are mixed together to form a musical tone signal regarding a consonant providing 4 formants.

An adder 203 receives the musical tone signal of the vowel, outputted from the VTG group 201, and the musical tone signal of the consonant, outputted from the UTG group 202, so as to add them together. Thus, the adder 203 creates a formant output (OUT) of the formant tone generator 108.

Figure 7A:
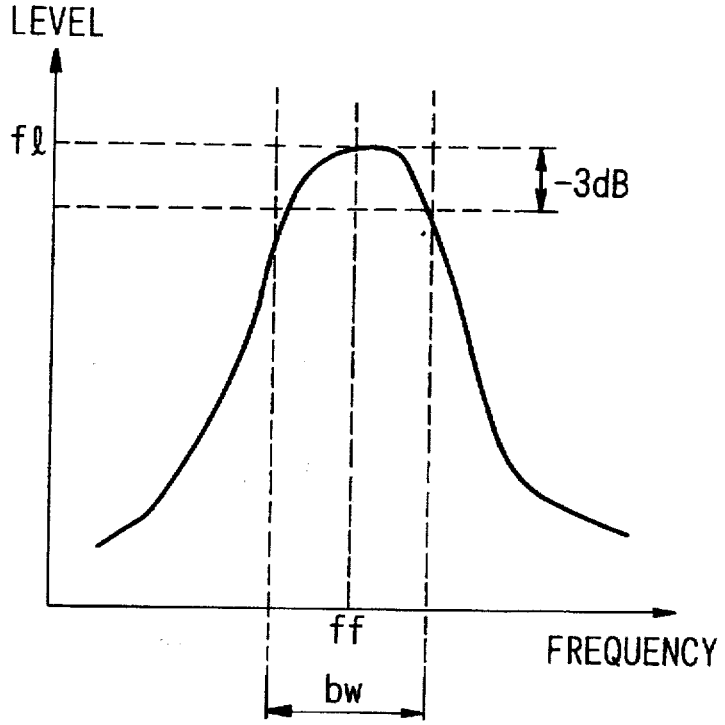
FIG. 7A is a graph showing variation of formant data defined by formant parameters.

Next, the description will be given with respect to the formant parameters which are created by the CPU 1 and are supplied to the formant tone generator 108. For convenience' sake, 1 formant is constructed by 3 parameters 'ff', 'fl' and 'bw' which are shown in FIG. 7A. A graph of FIG. 7A shows 1 formant in a form of power spectrum, wherein the parameter ff represents formant center frequency, the parameter fl represents a formant level and the parameter bw represents a formant bandwidth (in other words, sharpness of a peak portion of a formant waveform).

When generating a vowel, the CPU 1 sends a set of parameters ff, fl and bw, which define a first formant, to the tone generator VTG1 within the VTG group 201. SImilarly, 3 sets of parameters ff, fl and bw, which define a second formant, a third formant and a fourth formant respectively, are supplied to the tone generators VTG2, VTG3 and VTG4 respectively. Thus, the VTG group 201 produces a vowel having first to fourth formants which are defined by the above parameters. Similar operation is employed to generate a consonant. That is, 4 sets of parameters ff, fl and bw are respectively supplied to the tone generators UTG1 to UTG4 within the UTG group 202, so that the UTG group 202 produces a desired consonant.

When a sound synthesis system, employing the formant parameter creating method of the present embodiment, is used to speak words or sing a song, a series of formant parameters should be sequentially supplied to the formant tone generator 108 in a form of time-series data in order to regenerate formants which vary momentarily. However, it is necessary to simplify the construction of the system and to reduce the cost for manufacturing the system. In order to do so, the present embodiment uses the morphing technique. That is, the CPU 1 performs the morphing among multiple phonemes; in other words, the CPU 1 performs interpolation among the formant parameters. Thus, the CPU 1 creates time-series formant parameters. By supplying the time-series formant parameters to the formant tone generator 108, the system can speak words or sing a song. Thus, it is possible to realize the morphing between voices and musical tones based on a formant system.

Now, the description will be given with respect to the morphing which is performed for sounds containing phonemes of vowel formants only. In the system, there are provided tone-color files for phonemes of vowels such as 'a', 'i', 'u', 'e' and 'o' which are vowels in the Japanese syllabary. Each tone-color filter contains the parameters ff, fl and bw (see FIG. 7A), representing multiple (i.e., 4) formants regarding each phoneme, as well as other formant parameters. As for the formant center frequency ff, the tone-color file of the phoneme 'a' stores a series of frequencies such as a first frequency of ff (i.e., F1=697 Hz), a second frequency of ff (i.e., F2=1072 Hz) and a third frequency of ff (i.e., F3=2839 Hz). Similarly, the tone-color file of the phoneme 'u' stores a series of frequencies such as a first frequency of ff (i.e., F1=298 Hz), a second frequency of ff (i.e., F2=1288 Hz) and a third frequency of ff (i.e., F3=2104 Hz). Same manner can be applied to storage of the other parameters for the other phonemes.

Multiple pieces of information are required for the morphing to shift one phoneme to another phoneme. That is, it is necessary to provide multiple pieces of information which represent tone-color files of those phonemes, sounding times of the phonemes, interpolation dead rates and interpolation methods. If the morphing is performed to shift a first phoneme to a second phoneme, it is necessary to provide tone-color files which store formant parameters regarding the first and second phonemes. Other pieces of information, other than the tone-color files, will be described later with reference to FIG. 7B.

Figure 7B:
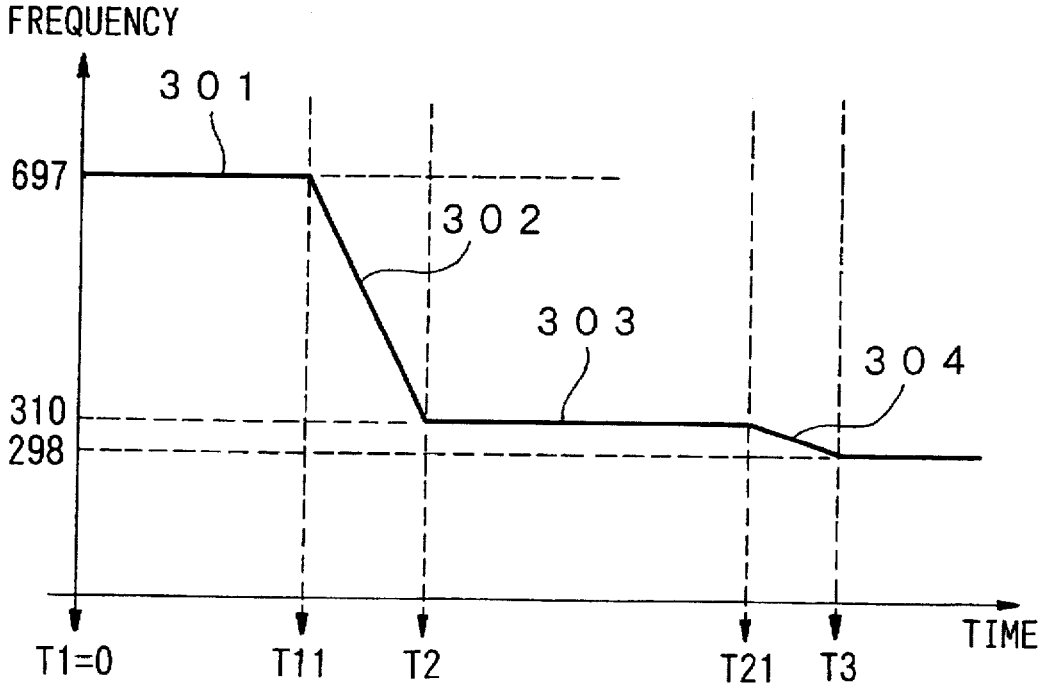
FIG. 7B is a graph showing variation of a formant center frequency which is varied responsive to morphing effected between vowels.

FIG. 7B is a graph showing a manner of interpolation for the formant center frequency ff when the morphing is performed to realize shifting of the phonemes 'a', 'i' and 'u'. In order to start generation of the phoneme 'a' at a first phoneme sounding-start-time T1=0, the CPU 1 continuously outputs the first frequency of ff (i.e., F1=697 Hz) until an interpolation start time T11, which is shown by a waveform section 301 in the graph of FIG. 7B. At the interpolation start time T11, the system starts shifting of the phonemes from 'a' to 'i'. So, interpolation is performed between the first frequency of ff for the phoneme 'a' (i.e., F1=697 Hz) and a first frequency of ff for the phoneme '1' (i.e., F1=310 Hz). Thus, the CPU 1 sequentially outputs results of the interpolation, which are shown by a waveform section 302. In a duration between a second phoneme sounding-start-time T2 and an interpolation time T21, the CPU 1 continuously outputs the first frequency of ff (i.e., F1=310 Hz) to generate the phoneme 'i', which is shown by a waveform section 303. At the interpolation start time T21, the system starts shifting of the phonemes from 'i' to 'u'. So, interpolation is performed between the first frequency of ff for the phoneme 'i' (i.e., F1=310 Hz) and the first frequency of ff for the phoneme 'u' (i.e., F1=298 Hz). Thus, the CPU 1 sequentially outputs results of the interpolation, which are shown by a waveform section 304. After a third phoneme sounding-start-time T3, the CPU 1 continuously outputs the first frequency of ff (i.e., F1=298 Hz) to generate the phoneme 'u'. Of course, the CPU 1 outputs other parameters other than the first frequency of ff.

Among the multiple pieces of information which are required to perform the morphing, the sounding time of each phoneme is defined as a period of time which is measured between a 'n' phoneme sounding-start-time and a 'n+1' phoneme sounding-start-time. For example, a period of time between the first phoneme sounding-start-time T1=0 and second phoneme sounding-start-time T2 is a sounding time of the phoneme 'a'; and a period of time between the second phoneme sounding-start-time T2 and third phoneme sounding-start-time T3 is a sounding time of the phoneme 'i'. By designating this information regarding the sounding time, it is possible to determine a sounding-start-time for a next phoneme. For example, by designating a sounding time for the phoneme 'a', the sounding time is added to the sounding-start-time T1 to determine the sounding-start-time T2 for the next phoneme 'i'.

Among the multiple pieces of information which are required to perform the morphing, the interpolation dead rate is defined as follows:

Interpolation dead rate
= {(interpolation start time for 'n' phoneme) - ('n' phoneme sounding-start-time)} / (sounding time of 'n' phoneme)
= {(interpolation start time for 'n' phoneme) - ('n' phoneme sounding-start-time)} / {('n + 1' phoneme sounding-start-time) - ('n' phoneme sounding-start-time)}

Incidentally, the interpolation dead rate can be designated for each phoneme; or a common interpolation dead rate can be used for all phonemes.

If the interpolation is performed directly in accordance with the conventional method, the interpolation is sometimes started at a sounding-start-time of each phoneme, which will cause difficulty of hearing of a sound. In the case of FIG. 7B, for example, if interpolation is started at the sounding-start-time for the phoneme 'a', the phoneme 'a' is immediately rewritten by the interpolation, which will cause a generated sound to be hardly recognized as the phoneme 'a'. So, the present system designates an interpolation dead rate when performing the morphing. Thus, the system outputs formant parameters of a phoneme directly in a period of time corresponding to result of multiplication in which an interpolation dead rate is multiplied by a sounding time of the phoneme; and after the duration passed away, an interpolation is performed to shift the phoneme to a next phoneme. Therefore, a period of time between the first phoneme sounding-start-time T1 and the interpolation start time T11 is calculated by multiplying a sounding time of the phoneme 'a', represented by 'T2–T1', by a designated interpolation dead rate. So, in the period of time between T1 and T11, the system outputs formant parameters, stored in the tone-color file of the phoneme 'a', directly. Thus, it is possible to make a generated sound to be clearly recognized as the phoneme 'a' by a person on the sense of hearing.

Among the multiple pieces of information which are required to perform the morphing, the interpolation method is used to designate either a linear interpolation method or a spline interpolation method.

FIG. 7B shows an example of interpolation which is performed for the vowels only. Next, the description will be given with respect to an example of interpolation which is performed for sounds containing consonants. In the Japanese language, syllables except the vowels (i.e., the phonemes 'a', 'i', 'u', 'e' and 'o') are each constructed by a pair of a consonant and a vowel; therefore, it is fundamentally unnecessary to perform interpolation on the consonant. So, when producing a Japanese word of "ha-si" (which means "chop sticks") by voices, the system realizes interpolation for vowels in accordance with the prescribed method whilst the system outputs formant parameters stored in tone-color files of consonants. By the way, a threshold value is set for a sounding level of a consonant; therefore, when a sounding level of a voice becomes lower than the threshold value, sounding of the consonant is started to follow sounding of a vowel.

Figure 8A:
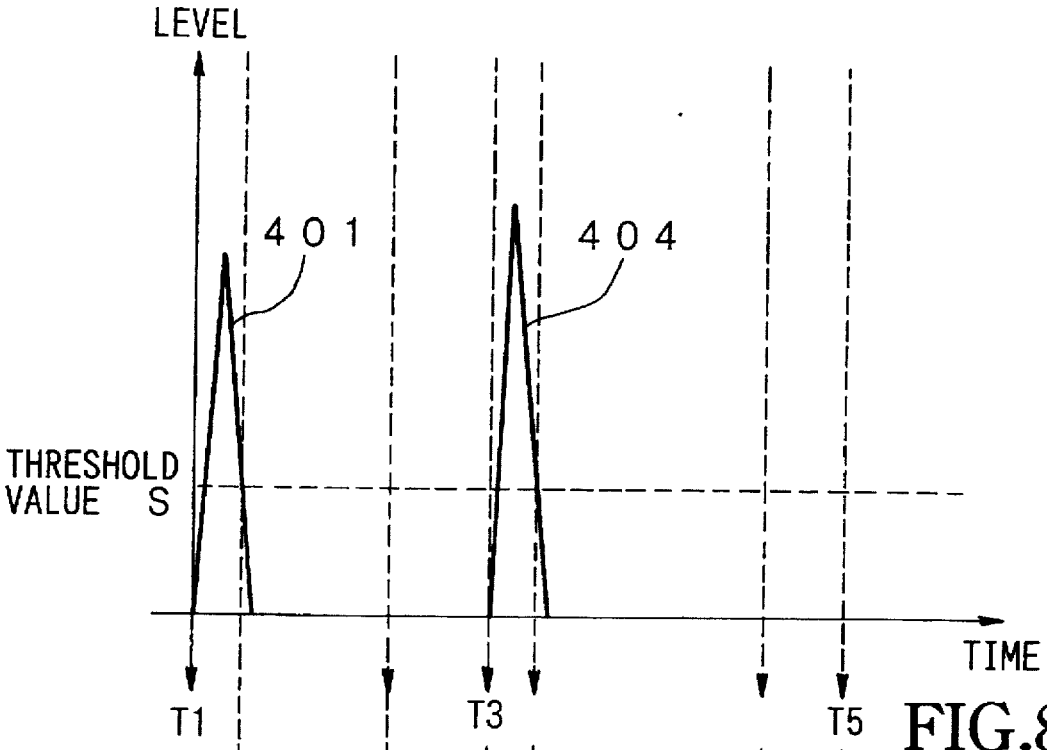
FIGS. 8A and 8B are graphs showing an example of variation of formant-level data which are varied responsive to morphing effected for combination of vowels and consonants.
Figure 8B:
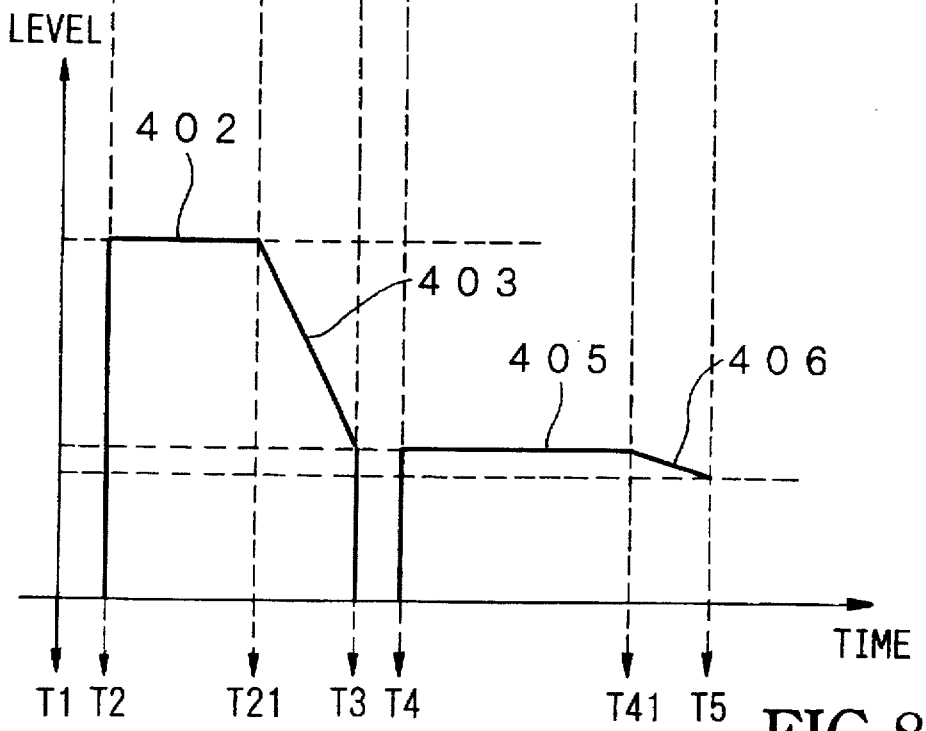

FIGS. 8A and 8B show examples of formant-level data used for the morphing which is performed to generate voices each consisting of a consonant and a vowel. Specifically, FIG. 8A shows two formant-level data corresponding to two consonants respectively whilst FIG.8B shows two formant-level data corresponding to two vowels respectively. FIGS. 8A and 8B show an example of the morphing by which a voice 'ha' is gradually shifted to a voice 'si' Herein, the voice 'ha' consists of a consonant 'h' and a vowel 'a' whilst the voice 'si' consists of a consonant 's' and a vowel 'i'.

In order to start generation of the consonant 'h' at a first phoneme sounding-start-time T1, a first formant level fl of the first phoneme (i.e., consonant 'h') is outputted in accordance with content of a tone-color file of the consonant 'h'. Variation of the first formant level fl is shown by a waveform section 401 in FIG. 8A. A moment, at which the first formant level fl of the first phoneme 'h' reaches a predetermined threshold value S, forms a second phoneme sounding-start-time T2 for a second phoneme (i.e., vowel 'a'). In order to start generation of the vowel 'a' at the second phoneme sounding-start-time T2, Its first formant level fl is outputted in accordance with content of a tone-color file of the second phoneme 'a'. Variation of the first formant level fl is shown by a waveform section 402. An interpolation start time T21 for the second phoneme 'a' is determined by a method like the aforementioned method which is described before with reference to FIG. 7B. That is, an interpolation dead rate is designated for the second phoneme 'a'. Then, a sounding time of the second phoneme 'a' (which corresponds to a period of time between a third phoneme sounding-start-time T3 and the second phoneme sounding-start-time T2) is multiplied by the designated interpolation dead rate, thus calculating a period of time between the second phoneme sounding-start-time T2 and an interpolation start time T21. Thus, it is possible to determine the interpolation start time T21.

At the interpolation start time T21, interpolation is started to gradually shift sounding of 'a' to sounding of 'i', both of which are vowels. This is because the interpolation is effected between the vowels only. Results of the interpolation are sequentially outputted as shown by a waveform section 403 in FIG. 8B. At a third phoneme sounding-start-time T3, the system outputs a first formant level fl for a third phoneme, i.e., a consonant 's', in accordance with content of a tone-color file of the consonant 's'. Variation of the first formant level fl is shown by a waveform section 404 in FIG. 8A. When the first formant level fl of the third phoneme 's' reaches the predetermined threshold value S, the system starts to output a first formant level fl regarding a fourth phoneme 'i'. Like the aforementioned second phoneme 'a', the system continues to output a first formant level fl of the fourth phoneme 'i' in a period of time between a fourth phoneme sounding-start-time T4 and an interpolation start time T41 in accordance with content of a tone-color file of the fourth phoneme 'i'. Variation of the first formant level fl is shown by a waveform section 405 in FIG. 8B. Then, interpolation is effected on the fourth phoneme 'i' in a period of time between the interpolation start time T41 and a fifth phoneme sounding-start-time TS. Results of the interpolation are sequentially outputted as shown by a waveform section 406 in FIG. 8B.

Figure 9A:
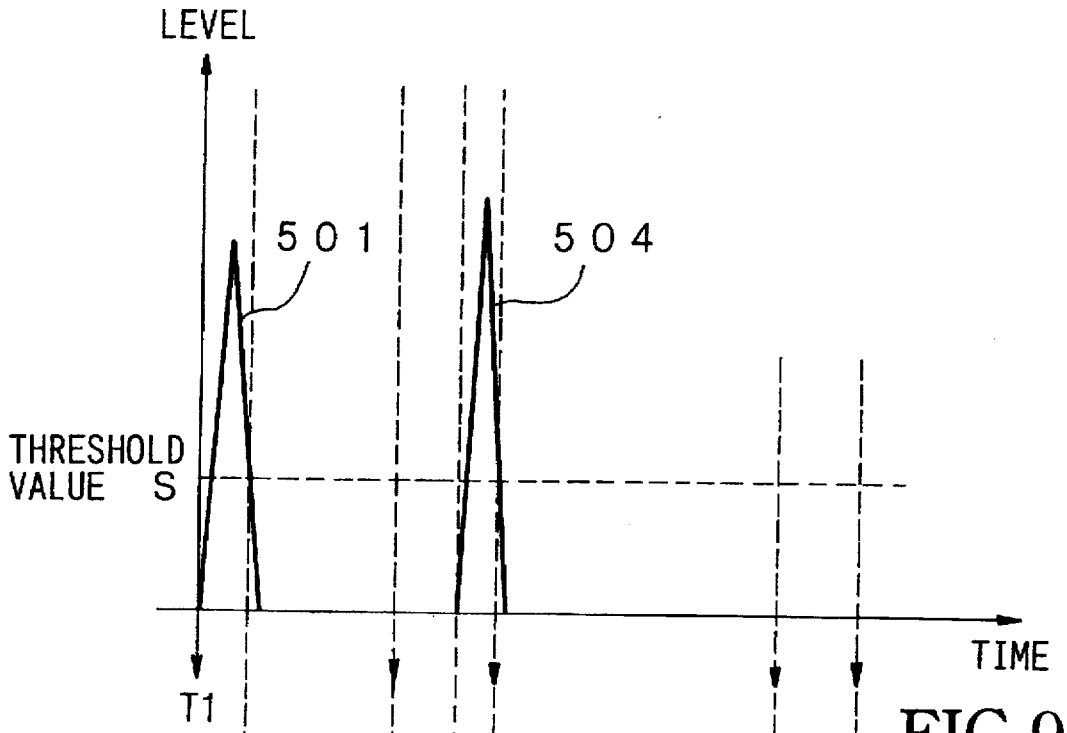
FIGS. 9A ana 9B are graphs showing another example of variation of formant-level data which are varied responsive to morphing effected for combination of vowels and consonants.
Figure 9B:
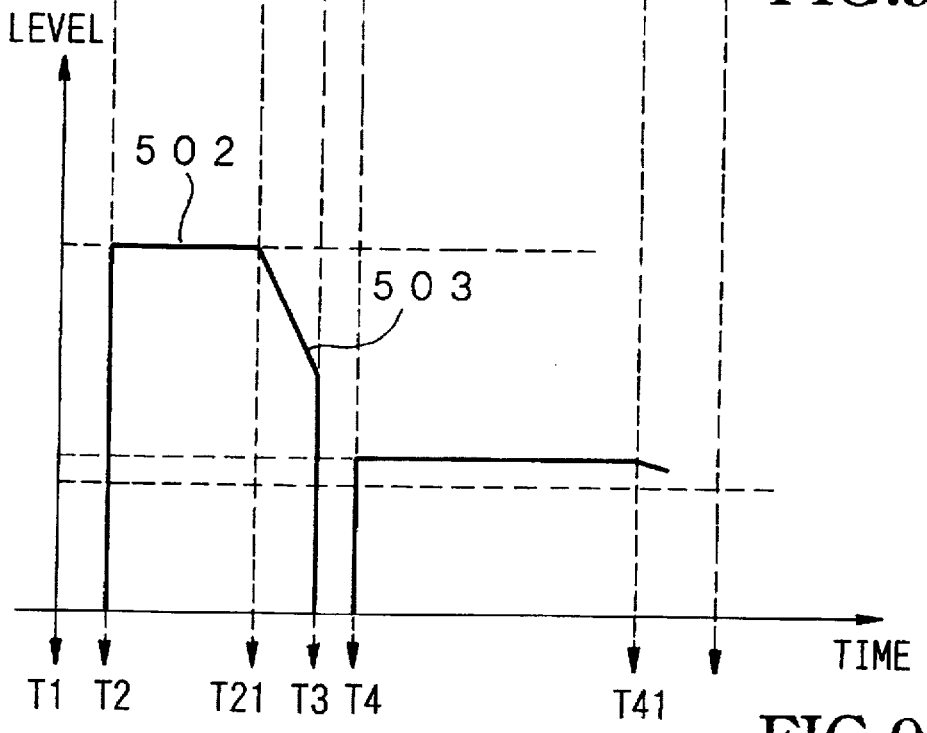

In general, the person can recognize each syllable, consisting of a consonant and a vowel, such that a timing to start generation of the vowel. Is recognized as a timing to start sounding of the syllable on the sense of hearing. In the example of FIGS. 8A and 8B, for example, the person recognizes the syllable 'si' as if sounding of the syllable 'si' is started at the fourth phoneme sounding-start-time T4 on the sense of hearing. That is, the person feels that a timing to start the sounding of the syllable 'si' is delayed behind the sounding-start-time T3 which is actually designated. In order to avoid such a delay, generation of a consonant can encroach upon generation of a vowel which should be sounded previously of the consonant. FIGS. 9A and 9B show another example of formant-level data which are determined to settle a problem due to the delay described above.

Like FIGS. 8A and 8B, FIGS. 9A and 9B show formant-level data with respect to generation of the Japanese word "ha-si". At first, the system starts to output a first formant level fl at a first phoneme sounding-start-time T1 in accordance with content of a tone-color file of the first phoneme 'h'. This is shown by a waveform section 501 in FIG. 9A. Then, the system sets a second phoneme sounding-start-time T2 for the second phoneme 'a' at a timing at which the first formant level fl of the first phoneme 'h' reaches a predetermined threshold value S. Then, the system outputs a first formant level fl for the second phoneme 'a' in accordance with content of a tone-color file of the second phoneme 'a'. This is shown by a waveform section 502 in FIG. 9B.

The example of FIGS. 9A and 9B is different from the aforementioned example of FIGS. 8A and 8B in a method to determine an interpolation start time T21 and a third phoneme sounding-start-time T3. Herein, a sounding time of the second phoneme 'a' is determined to continue until a timing to start generation of a next vowel. If the second phoneme is followed by a syllable consisting of a consonant and a vowel, the sounding time of the second phoneme is determined to continue until generation of the vowel which should be sounded after the consonant. In the example of FIGS. 9A and 9B, the second phoneme 'a' is followed by a syllable consisting of a consonant 's' and a vowel 'i'. So, the sounding time of the second phoneme 'a' is added to the second phoneme sounding-start-time T2 to determine a fourth phoneme sounding-start-time T4 for a fourth phoneme, i.e., the vowel 'i'. Then, the sounding time of the second phoneme (i.e., a period of time represented by 'T4–T2') is multiplied by an interpolation dead rate to calculate a period of time of 'T21–T2'. Thus, the interpolation start time T21 is determined. A third phoneme sounding-start-time T3 for a third phoneme 's' is determined by subtracting a sounding time of the third phoneme from the fourth phoneme sounding-start-time T4. The sounding time of the third phoneme 's', which is the consonant, is set merely by parameters. Or, the sounding time of the third phoneme 's' is set by parameters including envelope data. In that case, the sounding time can be calculated using the envelope data.

In the example of FIGS. 9A and 9B, the sounding time of 'T4–T2' is set for the second phoneme 'a'. However, sounding of the second phoneme is not necessarily retained during all the sounding time. Actually, the system stops to output formant parameters of the second phoneme 'a' at the third phoneme sounding-start-time T3 prior to a timing at which the sounding time 'T4–T2' is passed away from the second phoneme sounding-start-time T2. So, the system starts to output formant parameters of the third phoneme (i.e., consonant 's') at the third phoneme sounding-start-time T3. That is, sounding timings are adjusted such that generation of the third phoneme 's' encroach upon generation of the second phoneme 'a'. A syllable 'si' consisting of the third phoneme 's' and fourth phoneme 'i' is started to be sounded and is heard by a person as if sounding of the syllable 'si' is started at the fourth phoneme sounding-start-time T4. So, the person recognizes the syllable 'si' such that sounding of the syllable 'si' is properly started after a lapse of the sounding time of the second phoneme on the sense of hearing.

Next, the stored content of the data memory 104 is shown by FIG. 10. There are provided a formant parameter table 601 and a sequence table 602 in the data memory 104. Herein, the formant parameter table 601 stores formant parameters for a variety of formants. A numeral 'V FRMNT DATA' indicates tone-color files (i.e., formant parameters) for vowels. There are provided 5 tone-color files with respect to 5 vowels 'a', 'i', 'u', 'e' and 'o' respectively. A numeral 'U FRMNT DATA' indicates tone-color files (i.e., formant parameters) for consonants. For example, there are provided the tone-color files with respect to consonants 'b' and 'ch'.

A tone-color file of each phoneme consists of parameters '611', regarding first to fourth formants, a dead rate 'DEAD RATE' 612 and other data 'MISC' 613. Among the parameters 611, 'FRMNT FREQ1', 'FRMNT LVL1' and 'FRMNT BW1' represent formant center frequency, formant level and formant bandwidth respectively with respect to the first formant. Similarly, the parameters 611 contain elements regarding the second, third and fourth formants as well.

The sequence table 602 stores lyric data representing words of lyrics which are sounded as voices by the present system. Herein, a numeral 'LYRIC DATA' represents data of one lyric. So, there are provided multiple lyric data in the sequence table 602. One lyric data consist of data 621 (TITLE NAME) representing a title name of the lyric data, a plurality of event data 623, represented by '$VEVENT_1$' to '$VEVENT_n$', and end data 624 (END) representing an end of the lyric. Each event data '$VEVENT_i$' consist of 4 data blocks 625 to 628, wherein the data block 625 stores phoneme designating information (SEGMENT VOICE), which is used to designate a phoneme to be generated; the data block 626 stores an interpolation-dead-rate adjusting coefficient (DEAD RATE COEF); the data block 627 stores a sounding time of the phoneme (SEG DURATION); and the data block 628 stores other information (SEG MISC DATA). The other information 628 correspond to data which indicate a pitch and a tone volume for the phoneme.

If a consonant is designated by the phoneme designating information 625, the interpolation-dead-rate adjusting coefficient 626 and the sounding time 627 are not used because, they are meaningless for generation of the consonant. A sounding time of the consonant depends upon its envelope. Information regarding the envelope is contained in the other information 628.

If a sounding time of a phoneme in one event data exceeds a storage capacity of the data block 627, next event data is used to designate the sounding time '627' only. As for the event data which designate the sounding time only, contents of the data blocks except the data block 627 are all zero. In other words, event data whose data block 625 does not designate a phoneme are used to designate a sounding time only. As a result, such event data are used to merely extend a sounding time of a phoneme which is currently sounded.

Next, procedures for a lyric performance program, in which the present system generates words of a lyric by voices, will be described with reference to flowcharts of FIGS. 11, 12A, 12B, 12C, 13A and 13B. At first, one lyric data, designating a lyric to be performed, is selected from the sequence table 602 shown in FIG. 10. In first step 701 in FIG. 11, initialization is performed with respect to a variety of data. Particularly, a lyric-event pointer 'i', which designates event data, is set at '1'.

In step 702, the system reads event data $VEVENT_i$ which are designated by the lyric-event pointer i. In step 703, a decision is made as to whether or not the read data are end data END. If so, processing of the lyric performance program is terminated. If the read data are not the end data END, the system proceeds to step 704 in which a decision is made as to whether or not the data block 625 of the read event data $VEVENT_i$ stores phoneme designating information (SEGMENT VOICE) to designate a phoneme. If no phoneme is designated, it is determined that the read event data $VEVENT_i$ are used to designate only a sounding time (SEG DURATION) stored in the data block 627. So, the system proceeds to step 821 shown in FIG. 12C, wherein counting operation is performed for the sounding time (SEG DURATION). Thus, generation of a phoneme currently sounded is continued in a duration in which the counting operation is performed. In step 822, a decision is made as to whether or not the sounding time completely elapses. If not, program control returns to step 821 again, so that the counting operation is repeated. Thereafter, when the sounding time completely elapses, the system proceeds to step 911 shown in FIG. 13B. In step 911, the lyric-event pointer i is increased by '1'. Thereafter, the system proceeds back to step 702 in FIG. 11.

Meanwhile, if the data block 625 of the read event data stores phoneme designating information (SEGMENT VOICE) to designate a phoneme, the designated phoneme is represented by a numeral '$X_i$' in step 704. Then, the system proceeds to step 705 in which a decision is made as to whether or not the designated phoneme $X_i$ is a vowel. If the designated phoneme $X_i$ is not a vowel, in other words, if the designated phoneme $X_i$ is a consonant, the system proceeds to step 811 shown in FIG. 12B. In step 811, formant parameters (U FRMNT DATA Xi) for the designated phoneme $X_i$ are read out from the formant parameter table 601 in FIG. 10, so that the formant parameters are transferred to the UTG group 202 of the formant tone generator 108. Then, a key-on event is designated; that is, a key-on signal (UKON) is set at '1'. Thus, generation of a consonant is started. After execution of the step 811, the system proceeds to step 911 in FIG. 18B.

On the other hand, If the step 705 determines that the designated phoneme $X_i$ is a vowel, the system proceeds to step 706 in which a decision is made as to whether or not a previously designated phoneme $X_{i-1}$ is a consonant. If the previously designated phoneme $X_{i-1}$ is a consonant, it is necessary to start generation of the designated Phoneme $X_i$ (i.e., vowel) at a timing at which a sounding level of the consonant, which is currently generating, becomes lower than the predetermined threshold value S. So, the system proceeds to step 707 so as to check a sounding level of the previously designated phoneme $X_{i-1}$. In step 708, a decision is made as to whether or not the sounding level of the previously designated phoneme $X_{i-1}$ becomes lower than the predetermined threshold value S. If the sounding level of the previously designated phoneme $X_{i-1}$ is greater than the threshold value S, it is necessary to continue generation of the previously designated phoneme $X_{i-1}$. So, the system proceeds back to step 707. If the step 708 determines that the sounding level of the previously designated phoneme $X_{i-1}$ is less than the threshold value S, the system proceeds to step 801, shown in FIG. 12A, so as to start generation of its 'next' designated phoneme $X_i$ (i.e., vowel). By the way, if the previously designated phoneme $X_{i-1}$ is a vowel, it is allowed to start generation of its next designated phoneme $X_i$. So, the system proceeds to step 801 from step 706.

Incidentally, checking processes made by the steps 707 and 708 can be realized by directly monitoring an output of the UTG group 202; or the sounding level can be checked by approximation calculations executed by software processes. Or, the checking processes can be performed after a key-on event of a consonant.

In step 801, the system accesses the formant parameter table 601 (see FIG. 10) to read out formant parameters (V FRMNT DATA Xi) regarding the designated phoneme $X_i$. The formant parameters are transferred to the VTG group 201 provided in the formant tone generator 108; then, the system designates a key-on event, in other words, the system sets a key-on signal VKON at '1'. Thus, generation of the designated phoneme $X_i$ (i.e., vowel) is started. In next step 802, the system calculates a pre-interpolation time Tsi, which represents an interval of time between a sounding-start-time and an interpolation start time, as follows:

$$Tsi=(SEG\ \text{DURATION}i)\times(\text{DEAD RATE}\ COEFi)\times(\text{DEAD RATE}x)$$

That is, the sounding time (SEG DURATIONi) of the designated phoneme $X_i$, which is currently generating, is multiplied by the interpolation dead rate (DEAD RATE) of this phoneme and the interpolation-dead-rate adjusting coefficient (DEAD RATE COEFi) which is designated by event data; thus, a result of multiplication indicates the pre-interpolation time Tsi which is required as a period of time before the starting of the interpolation.

The interpolation-dead-rate adjusting coefficient (DEAD RATE COEF) is used to partially adjust the interpolation dead rate (DEAD RATE). Normally, a time for starting of interpolation can be determined by using the interpolation dead rate only, which is explained before with reference to FIGS. 8A and 8B. In some eases, however, It is demanded to partially adjust the interpolation dead rate in response to arrangement of words of a lyric. In order to cope with those cases, the interpolation-dead-rate adjusting coefficient is used to partially adjust the interpolation dead rate. Thus, it is possible to output formant parameters with an optimum interpolation dead rate which corresponds to arrangement of words of a lyric. So, it is possible to generate the words of the lyric which can be heard as natural voices on the sense of hearing.

As described above, the pre-interpolation time Tsi is calculated in step 802. In next step 803, a counting process is performed on the pre-interpolation time Tsi. In step 804, a decision is made as to whether or not the pre-interpolation time Tsi completely elapses. If not, program control goes back to step 803, so that the counting process is continued. If the pre-interpolation time Tsi completely elapses, the system proceeds to step 805 so as to start interpolation.

In step 805, the system calculates an interpolation time TIi as follows:

$$TIi=(SEG\ \text{DURATION}i)-Tsi$$

That is, the interpolation time TII is calculated by subtracting the pre-interpolation time Tsi from the sounding time (SEG DURATION) of the designated phoneme $X_i$. In next step 806, a searching process is started from event data, which follow event data regarding the designated phoneme $X_i$ (i.e., vowel), so as to find out event data (VEVENT) in which a vowel is designated as a designated phoneme (SEGMENT VOICE). Generally, a vowel is followed by another vowel or a consonant whilst a consonant is certainly followed by a vowel. So, the step 806 searches out '$X_{i+1}$' or '$X_{i+2}$'.

Figure 13A:
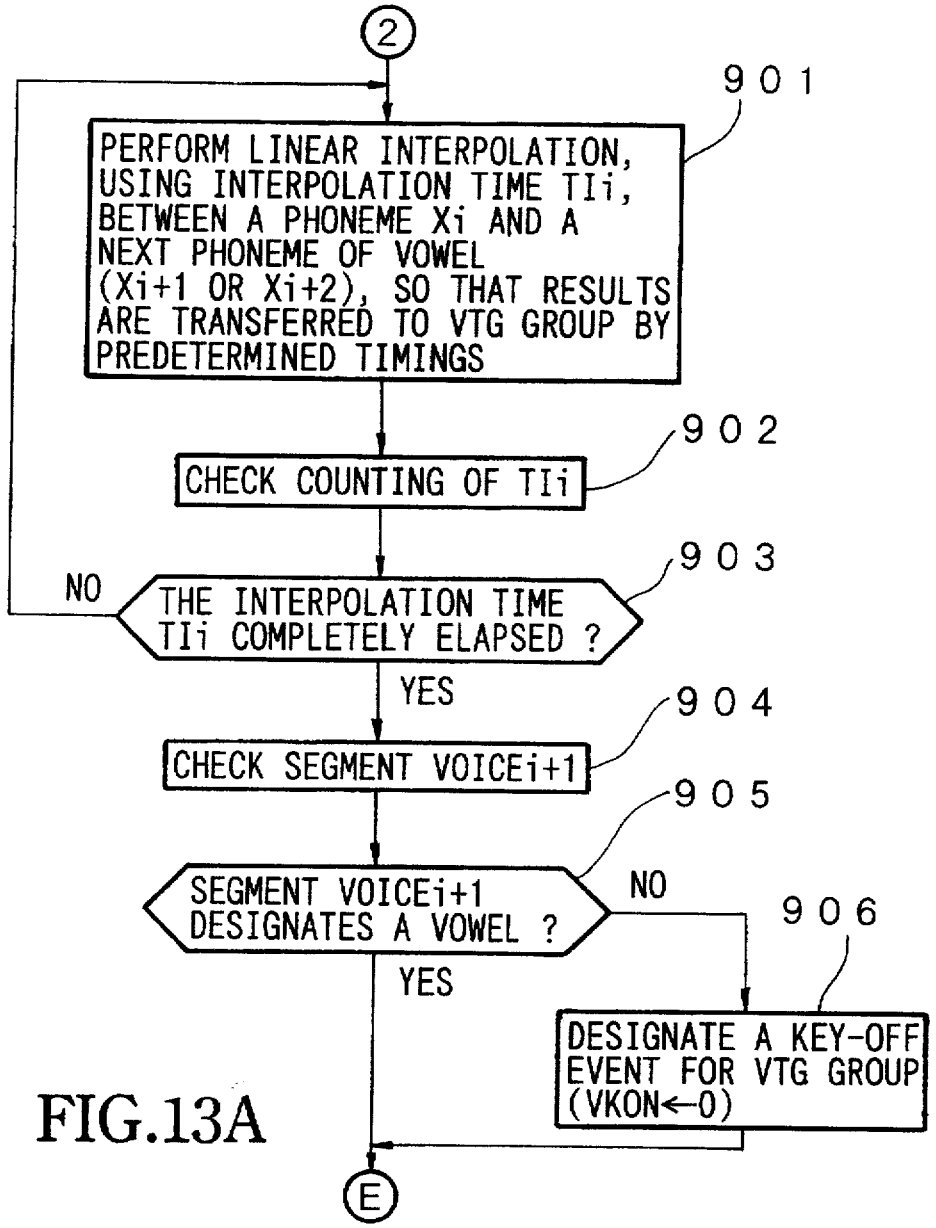
Figure 13B:
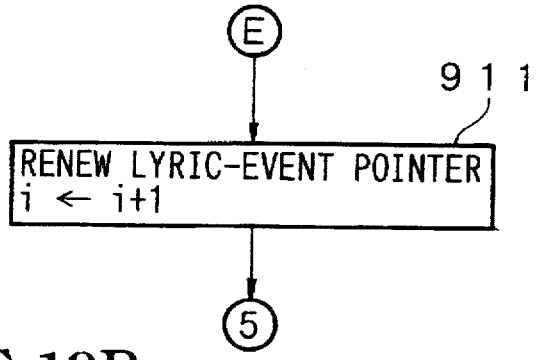

After completion of the searching process of step 806, the system proceeds to step 901 shown in FIG. 13A. In step 901, linear interpolation is performed, using the interpolation time TIi, between the designated phoneme $X_i$, which is a vowel currently generated, and its next phoneme, i.e., $X_{i+1}$ or $X_{i+2}$ representing a vowel. Results of the linear interpolation are transferred to the VTG group 201 of the formant tone generator 108 by each predetermined timing. In next step 902, the system checks counting of the interpolation time TIi. In step 903, a decision is made as to whether or not the interpolation time completely elapses. If the interpolation time TIi does not completely elapse, program control goes back to step 901. Thus, the interpolation is performed; and results thereof are outputted. If the interpolation time TIi completely elapses, the system proceeds to step 904 so as to refer to a designated phoneme (SEGMENT VOICEi+1) of next event data. In step 905, a decision is made as to whether or not the designated phoneme (SEGMENT VOICEi+1) is a vowel. If the designated phoneme is not a vowel, it is indicated that generation of a consonant is to follow. In that case, the system proceeds to step 906 in which the system designates a key-off event, in other words, the system inputs '0' to a key-on signal VKON which is sent to the VTG group 201 of the formant tone generator 108. Thus, the system stops generation of the designated phoneme $X_i$ which is currently generated. Then, the system proceeds to step 911, shown in FIG. 13B, in order to perform sound generation of next event data. On the other hand, if the step 905 indicates that generation of a next vowel is to follow, it is possible to perform generation of the next vowel without muting a vowel which is currently generated. So, the system directly proceeds to step 911.

According to the procedures of the lyric performance program which are shown by FIGS. 11, 12A, 12B, 12C, 13A and 13B, it is possible to output formant parameters which are explained before with reference to FIGS. 7B, 8A and 8B.

The aforementioned procedures of the lyric performance program can be also used to realize a sound generation manner, which is explained before with reference to FIGS.

9A and 9B, such that generation of a consonant is started to encroach upon generation of a vowel which is placed before the consonant. In order to do so, the aforementioned procedures of the lyric performance program can be used with changing contents of some steps as follows:

At first, the content of the step 805 is changed such that the interpolation time TIi is calculated by an equation as follows:

$$TIi=(SEG\ \text{DURATION}i)-\{Tsi+(\text{sounding time of a next consonant } X_{i+1})\}$$

That is, the pre-interpolation time Tsi is added to the sounding time of the next consonant $X_{i+1}$ which is an estimated time; then, result of addition is subtracted from the sounding time (SEG DURATIONi) of the designated phoneme $X_i$ which is a vowel. Incidentally, if the next phoneme $X_{i+1}$ is a vowel, It is not necessary to change the content of the step 805. In addition, the content of the step 901 is changed such that the interpolation is not performed using the interpolation time TIi but is performed using sum of the interpolation time TIi and the sounding time of the next phoneme $X_{i+1}$. Thus, it is possible to output formant parameters which are explained before with reference to FIGS. 9A and 9B.

In the system described heretofore, time management for managing timings to start interpolation and generation of a next phoneme is performed with respect to each event such that a certain time, which is required, is counted and a decision is made as to whether or not the certain time elapses. However, the time management applicable to the invention is not limited to the above. So, the system can be modified such that the time management is performed using an interrupt process.

In addition, the system provides an interpolation dead rate so as to certainly output formant parameters for a certain formant in a duration corresponding to its sounding time multiplied by the interpolation dead rate. According to such a technique, if the sounding time is relatively short, an interpolation time should be correspondingly made short so that a person feels as if generation of sounds is intermittently broken. Normal linear interpolation can be used as long as the sounding time is greater than a predetermined time. However, another interpolation method (e.g., interpolation using exponential function) may be used for generation of a vowel whose sounding time is relatively short. Herein, another interpolation method is effected in such a way that at an initial stage of generation of a vowel, its sounding level is gradually varied to a target value whilst at a latter stage, variation to the target value is made sharp. So, the interpolation is effected such that the sounding level is subjected to 'gradual' variation in the initial stage. This may provide an effect that a time for the interpolation dead rate is substantially secured.

The system is designed such that the interpolation dead rate is determined with respect to each phoneme, i.e., each vowel and each consonant. This is shown by the formant parameter table 601 in FIG. 10, the content of which is mainly divided to two sections, i.e., vowel section and consonant section. However, it is not necessary to divide the content of the table in such a way. So, it is possible to provide interpolation dead rates with respect to 50 syllables of the Japanese syllabary respectively. In other words, it is possible to provide formant parameters, containing those interpolation dead rates, with respect to the 50 syllables respectively.

The system is designed to perform the morphing between phonemes. However, It is possible to perform the morphing between a voice and a musical tone (i.e., musical tone based on formant system). Further, the system can be built in the electronic musical instrument; or the system can be realized by application software which runs in a personal computer.

Incidentally, the electronic musical apparatus of the present embodiments is designed to synthesize voices for singing a song. However, the electronic musical apparatus of the invention can be applied to synthesis of musical tones. Herein, a consonant section of a voice may correspond to an attack portion in a waveform of a musical tone whilst a vowel section of the voice may correspond to a constant portion in the waveform of the musical tone. Particularly, musical tones generated by wind instruments are similar to human voices because sounding of the wind instrument is controlled by breath of a performer. This means that voice synthesis technology used in the invention can be easily applied to sounding control of musical tones of the wind instruments.

For example, a musical tone generated by a wind instrument is divided into an attack portion and a constant portion. So, sound synthesis for the attack portion is controlled by a method which is similar to the aforementioned method to control the consonant whilst sound synthesis for the constant portion is controlled by a method which is similar to the aforementioned method to control the vowel. Thus, it is possible to obtain a variety of musical-tone outputs from the electronic musical apparatus of the invention.

[C] Applicability the invention

Figure 14:
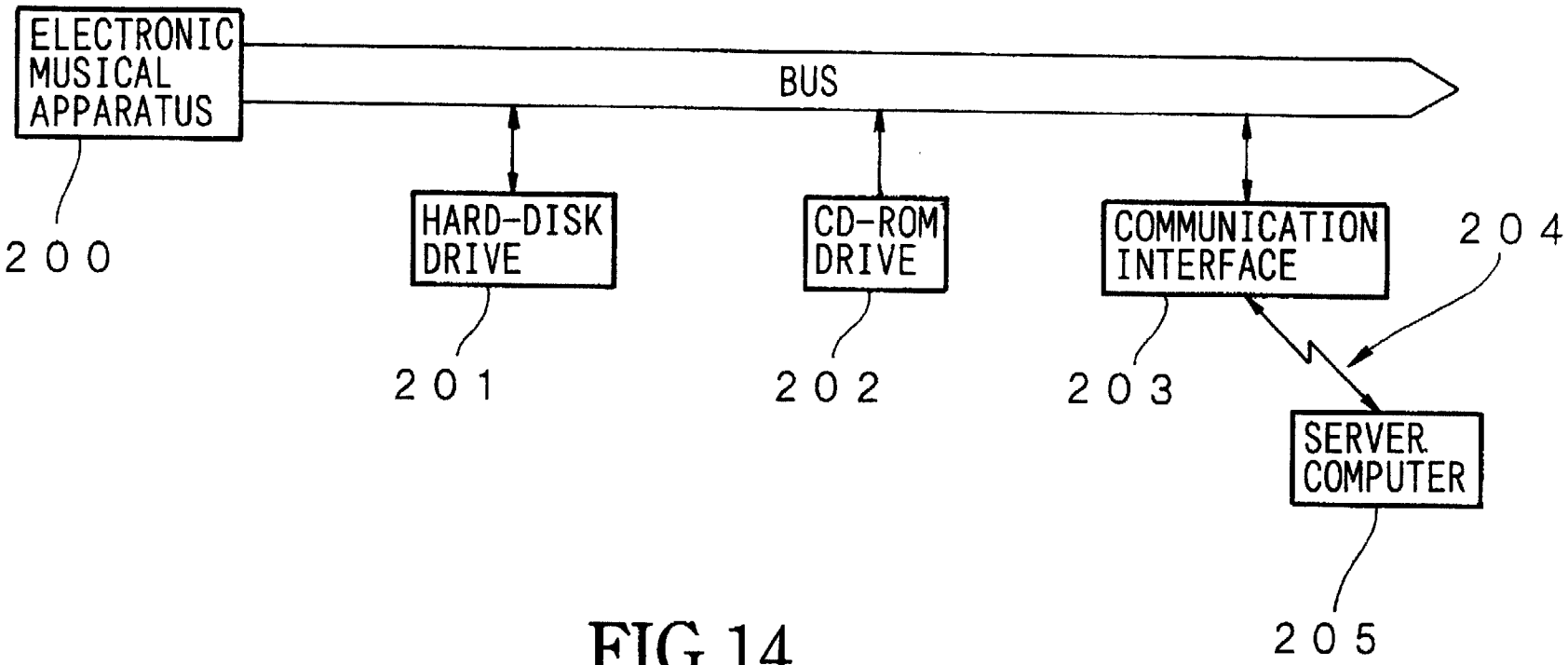
FIG. 14 is a block diagram showing an example of a system which incorporates an electronic musical apparatus of the invention.

Applicability of the electronic musical apparatus of the invention (see FIG. 1) can be extended in a variety of manners. For example, FIG. 14 shows a System in which an electronic musical apparatus 200 is connected to a hard-disk drive 201, a CD-ROM drive 202 and a communication interface 203 through a bus. Herein, the hard-disk drive 201 provides a hard disk which stores operation programs as well as a variety of data such as automatic performance data and chord progression data. If the ROM 2 of the electronic musical apparatus 200 does not store the operation programs, the hard disk of the hard-disk drive 201 stores the operation programs, which are then transferred to the RAM 3 on demand so that the CPU 1 can execute the operation programs. If the hard disk of the hard-disk drive 201 stores the operation programs, it is possible to easily add, change or modify the operation programs to cope with a change of a version of a software.

In addition, the operation programs and a variety of data can be recorded in a CD-ROM, so that they are read out from the CD-ROM by the CD-ROM drive 202 and are stored in the hard disk of the hard-disk drive 201. Other than the CD-ROM drive 202, it is possible to employ any kinds of external storage devices such as a floppy-disk drive and a magneto-optic drive (i.e., MO drive).

The communication interface 208 is connected to a communication network 204 such as a local area network (i.e., LAN), a computer network such as 'internet' or telephone lines. The communication network 204 also connects with a server computer 205. So, programs and data can be downloaded to the electronic musical apparatus 200 from the server computer 205. Herein, the system issues commands to request 'download' of the programs and data from the server computer 205; thereafter, the programs and data are transferred to the system and are stored in the hard disk of the hard-disk drive 201.

Moreover, the present invention can be realized by a 'general' personal computer which installs the operation programs and a variety of data which accomplish functions of the invention such as the function of formant sound synthesis. In such a case, it is possible to provide a user with the operation programs and data pre-stored in a storage medium such as a CD-ROM and floppy disks which can be accessed by the personal computer. If the personal computer is connected to the communication network, It is possible to provide a user with the operation programs and data which are transferred to the personal computer through the communication network.

As this invention may be embodied in several forms without departing from the spirit of essential characteristics thereof, the present embodiments are therefore illustrative and not restrictive, since the scope of the invention is defined by the appended claims rather than by the description preceding them, and all changes that fall within meets and bounds of the claims, or equivalence of such meets and bounds are therefore intended to be embraced by the claims.

What is claimed is:

1. An electronic musical apparatus comprising:

storage means for storing formant data and performance data, the performance data including lyric data corresponding to words of a lyric of a song to be sung and melody data corresponding to a melody of the song, the lyric data including breath data, the melody data including sounding duration data;

voice synthesis means for synthesizing voices corresponding to the words of the lyric, based on the formant data and the performance data which designate sounds to be generated in accordance with the melody of the song; and control means for controlling the voice synthesis means such that the sounds are generated in accordance with the performance data, the control means accessing the storage means to sequentially read out the performance data in accordance with the melody to supply the voice synthesizing means with the corresponding formant data, wherein the control means controls a sounding duration of the sounds in accordance with at least one of the breath data and the sounding duration data.

2. An electronic musical apparatus comprising:

storage means for storing words of a lyric of a song to be sung as well as breath information indicating timings of pausing for breath;

voice synthesis means for automatically synthesizing voices, corresponding to the words of the lyric, based on performance data which indicate a melody of the song; and control means for controlling the voice synthesis means based on the breath information such that the voices are generated in accordance with the melody but generation of the voices is temporarily stopped at the timings of pausing for breath.

3. An electronic musical apparatus according to claim 2 wherein the performance data are stored in the storage means.

4. An electronic musical apparatus comprising:

storage means for storing a plurality of formant data, lyric data and melody data with respect to a song to be sung, wherein the plurality of formant data respectively correspond to syllables of a language by which the song is sung whilst the lyric data designate words of a lyric of the song as well as timings of pausing for breath;

formant synthesis means for synthesizing voices based on the plurality of formant data selectively designated by the lyric data so that the voices are sequentially generated in accordance with the words of the lyric and are collected to sing the song in accordance with a melody of the song designated by the melody data; and breath control means for controlling the formant synthesis means such that the voices are generated but generation of the voices is temporarily stopped at the timings of pausing for breath.

5. An electronic musical apparatus according to claim 4 wherein the formant synthesis means consists of a plurality of tone-generator channels, each of which consists of vowel formant generating sections and consonant formant generating sections which selectively cooperate with each other to form a voice corresponding to a syllable of the language.

6. An electronic musical instrument according to claim 4 wherein the plurality of formant data respectively correspond to 50 vocal sounds of the Japanese syllabary.

7. A formant parameter creating method, applicable to an electronic musical apparatus employing a formant tone generator which operates based on formant parameters, comprising the steps of:

outputting formant parameters, corresponding to a first phoneme, to the formant tone generator in a duration which is determined in advance;

starting interpolation on the formant parameters after a lapse of the duration, wherein the interpolation is effected to shift sounding of the formant tone generator from the first phoneme to a second phoneme; and sequentially outputting results of the interpolation to the formant tone generator, whereby the formant tone generator synthesizes formant-related sound based on the first and second phonemes.

8. A formant parameter creating method, applicable to an electronic musical apparatus employing a formant tone generator which operates based on formant parameters, comprising the steps of:

multiplying a sounding time of a first phoneme by an interpolation dead rate, which is determined in advance, so as to calculate a pre-interpolation time between a first phoneme sounding-start-time and an interpolation start time;

outputting formant parameters, corresponding to the first phoneme, to the formant tone generator during the pre-interpolation time;

detecting a lapse of the pre-interpolation time;

starting interpolation on the formant parameters after the lapse of the pre-interpolation time, wherein the interpolation is effected to shift sounding of the formant tone generator from the first phoneme to a second phoneme; and sequentially outputting results of the interpolation to the formant tone generator, whereby the formant tone generator synthesizes formant-related sound based on the first and second phonemes.

9. A formant parameter creating method according to claim 8 wherein the interpolation dead rate is a constant which is commonly used for each phoneme.

10. A formant parameter creating method according to claim 8 wherein the interpolation dead rate is determined with respect to each phoneme.

11. A formant parameter creating method according to claim 8 wherein an interpolation-dead-rate adjusting coefficient is further used such that the sounding time of the first phoneme is multiplied by the interpolation dead rate and the interpolation-dead-rate adjusting coefficient so as to calculate a pre-interpolation time between the first phoneme sounding-start-time and the interpolation start time, wherein the interpolation-dead-rate adjusting coefficient is determined with respect to each phoneme.

12. A formant parameter creating method, applicable to an electronic musical apparatus employing a formant tone generator which operates based on formant parameters, comprising the steps of:

multiplying a sounding time of a first phoneme by an interpolation dead rate, which is determined in advance, so as to calculate a pre-interpolation time between a first phoneme sounding-start-time and an interpolation start time;

subtracting the pre-interpolation time from the sounding time of the first phoneme so as to calculate an interpolation time;

outputting formant parameters, corresponding to the first phoneme, to the formant tone generator during the pre-interpolation time;

detecting a lapse of the pre-interpolation time;

starting interpolation, using the interpolation time, on the formant parameters after the lapse of the pre-interpolation time, wherein the interpolation is effected to shift sounding of the formant tone generator from the first phoneme to a second phoneme;

sequentially outputting results of the interpolation to the formant tone generator;

detecting a lapse of the interpolation time; and outputting formant parameters, regarding the second phoneme, to the formant tone generator, whereby the formant tone generator synthesizes formant-related sound based on the first and second phonemes.

13. A formant parameter creating method, applicable to an electronic musical apparatus employing a formant tone generator which operates based on formant parameters, comprising the steps of:

multiplying a sounding time of a first phoneme by an interpolation dead rate, which is determined in advance, so as to calculate a pre-interpolation time between a first phoneme sounding-start-time and an interpolation start time;

subtracting a sum of the pre-interpolation time and a sounding time of a second phoneme from the sounding time of the first phoneme so as to calculate an interpolation time;

outputting formant parameters, corresponding to the first phoneme, to the formant tone generator during the pre-interpolation time;

detecting a lapse of the pre-interpolation time;

starting interpolation, using a sum of the interpolation time and the sounding time of the second phoneme, on the formant parameters after the lapse of the pre-interpolation time, wherein the interpolation is effected to shift sounding of the formant tone generator from the first phoneme to the second phoneme;

sequentially outputting results of the interpolation to the formant tone generator;

detecting a lapse of the interpolation time; and outputting formant parameters, regarding the second phoneme, to the formant tone generator after the lapse of the interpolation time, whereby the formant tone generator synthesizes formant-related sound based on the first and second phonemes.

14. A formant parameter creating method, applicable to an electronic musical apparatus employing a formant tone generator which operates based on formant parameters, comprising the steps of:

performing first interpolation at an initial stage of a sounding time of a first phoneme such that formant parameters of the first phoneme are shifted to formant parameters of a second phoneme at a first pace;

sequentially outputting results of the first interpolation to the formant tone generator;

performing second interpolation at a latter stage of the sounding time of the first phoneme such that formant parameters of the first phoneme are shifted to the formant parameters of the second phoneme at a second pace, wherein said first pace is slower than said second pace; and sequentially outputting results of the second interpolation to the formant tone generator, whereby the formant tone generator synthesizes formant-related sound based on the first and second phonemes.

15. A storage device storing a plurality of formant data, lyric data and melody data with respect to a song to be sung, wherein the plurality of formant data respectively correspond to syllables of a language by which the song is sung whilst the lyric data designate words of a lyric of the song as well as timings of pausing for breath, the storage device further storing programs which cause an electronic musical apparatus to execute a lyric performance method comprising the steps of:

synthesizing voices based on the plurality of formant data selectively designated by the lyric data so that the voices are sequentially generated in accordance with the words of the lyric and are collected to sing the song in accordance with a melody of the song designated by the melody data; and controlling the voices such that the voices are generated but generation of the voices is temporarily stopped at the timings of pausing for breath.

16. A storage device storing programs and formant parameters which cause an electronic musical apparatus, employing a formant tone generator, to execute a formant parameter creating method comprising the steps of:

outputting formant parameters, corresponding to a first phoneme, to the formant tone generator in a duration which is determined in advance;

starting interpolation on the formant parameters after a lapse of the duration, wherein the interpolation is effected to shift sounding of the formant tone generator from the first phoneme to a second phoneme; and sequentially outputting results of the interpolation to the formant tone generator, whereby the formant tone generator synthesizes formant-related sound based on the first and second phonemes.

17. A storage device according to claim 16 wherein the first phoneme corresponds to a consonant whilst the second phoneme corresponds to a vowel.

* * * * *